US008888922B2

(12) United States Patent
Ortmann et al.

(10) Patent No.: US 8,888,922 B2
(45) **Date of Patent: *Nov. 18, 2014**

(54) FOAMING DRAIN CLEANER

(71) Applicant: Ecolab USA Inc., Saint Paul, MN (US)

(72) Inventors: Nathan R. Ortmann, Buffalo, MN (US); Anthony Erickson, Golden Valley, MN (US); Thomas R. Mohs, Eagan, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/837,749

(22) Filed: Mar. 15, 2013

(65) Prior Publication Data

US 2014/0274853 A1 Sep. 18, 2014

(51) Int. Cl.

| | |
|---|---|
| ***C11D 1/12*** | (2006.01) |
| ***C11D 1/75*** | (2006.01) |
| ***C11D 1/88*** | (2006.01) |
| ***C11D 3/386*** | (2006.01) |
| ***C11D 9/42*** | (2006.01) |
| ***B08B 3/04*** | (2006.01) |

(52) U.S. Cl.

CPC ..... *C11D 3/38663* (2013.01)
USPC ..... 134/22.11; 134/39; 134/40; 510/194; 510/195; 510/372; 510/374; 510/375; 510/393; 510/406

(58) Field of Classification Search

CPC ..... B08B 3/04; C11D 1/12; C11D 1/75; C11D 1/88; C11D 3/386; C11D 3/3947; C11D 9/42
USPC ..... 510/194, 195, 372, 374, 375, 393, 406; 134/22.11, 39, 40
See application file for complete search history.

(56) References Cited

U.S. PATENT DOCUMENTS

| | | | | |
|---|---|---|---|---|
| 5,393,789 | A | 2/1995 | Eggensperger et al. | |
| 6,017,872 | A | 1/2000 | Pedersen et al. | |
| 6,197,739 | B1 * | 3/2001 | Oakes et al. | 510/392 |
| 6,627,657 | B1 | 9/2003 | Hilgren et al. | |
| 6,632,397 | B1 | 10/2003 | Henderson et al. | |
| 2003/0114340 | A1 * | 6/2003 | Ajmani et al. | 510/372 |
| 2003/0199411 | A1 * | 10/2003 | Ajamani et al. | 510/195 |
| 2004/0147423 | A1 * | 7/2004 | Scialla et al. | 510/372 |
| 2006/0293212 | A1 | 12/2006 | Griese et al. | |
| 2009/0203567 | A1 | 8/2009 | Fernholz et al. | |
| 2009/0263539 | A1 | 10/2009 | Herdt et al. | |
| 2009/0263884 | A1 | 10/2009 | Mehta | |

* cited by examiner

*Primary Examiner* — Brian P Mruk
(74) *Attorney, Agent, or Firm* — Fredrikson & Byron, P.A.

(57) ABSTRACT

A drain cleaner may be used on a periodic basis to clean soil residues from residential and commercial waste drains. The drain cleaner may chemically self-foam to fill a waste drain with the foam. For example, the drain cleaner may be provided in two or more parts that are physically intermixed during use of the drain cleaner. One part may include hydrogen peroxide and water while another part may include a catalase, an amylase, a protease, and an enzyme stabilizer. The drain cleaner may also include a surfactant present in at least one of the first part and the second part. Additionally, in some examples, the drain cleaner includes a sanitizing agent present in either of the two parts or in yet a third physically separate part. During use, the different drain cleaner parts can be dispensed simultaneously into a drain to generate a cleaning and/or sanitizing foam in-situ.

21 Claims, 5 Drawing Sheets

FOAMING DRAIN CLEANER

TECHNICAL FIELD

This disclosure relates to cleaners and, more particularly, to foaming cleaners for cleaning drains.

BACKGROUND

Drains in commercial and residential facilities can become soiled during the course of normal use. As materials such as fatty substances, protein, cellulose fibers, soap, and particulate debris, to name a few examples, are flushed down the drain, the materials can adhere to sidewalls of the drain. Over time, the materials can accumulate on the sidewalls of the drain and create a source of bacterial growth, odors, and an attractant for undesirable pests such as drain flies. If the problem becomes severe enough, the drain can become completely plugged so that water and other debris back up at the drain inlet, creating a sanitary issue. This can be particularly problematic for commercial facilities subject to rigorous health and sanitation regulations. For example, institutions such as food and beverage processing facilities, hospitals and health care facilities, restaurants, grocery stores, and hotels may be subject to fines and other regulatory punishment if unsanitary conditions associated with a soiled drain are detected.

To help avoid having any drain issues, a facility may clean its drains on a periodic basis using a drain cleaner. For example, a facility may perform a three step cleaning process on a drain in which the drain is first cleaned with a drain cleaner, then washed, and finally disinfected with a sanitizer. During such a process, the drain cleaner may be introduced into the drain using a mechanical foaming device that mixes the drain cleaner with air to create a foam. The foam may more evenly distribute the drain cleaner on the sidewalls of drain than if the drain cleaner is simply poured down the drain.

SUMMARY

In general, this disclosure is directed to a foaming drain cleaner. The drain cleaner may be provided in at least two parts: a first part that contains hydrogen peroxide and a second part that contains catalase to catalyze decomposition of the hydrogen peroxide to water and oxygen. One or both of the parts may contain a variety of components to perform cleaning functions and to build and maintain the foam such as, e.g., an amylase, a protease, and a surfactant. In use, the first part is combined with the second part to release oxygen and chemically self-foam the drain cleaner. The composition of the drain cleaner may be effective to generate a fast-acting foam that fills the drain with foam fast enough so that the foam cannot push through the drain trap and discharge from the drain. In addition, the composition may be effective to generate foam that is stable enough so that the foam and chemical contents therein contact the sidewalls of the drain for a minimum period of time, such as a minimum of five minutes. For example, the drain cleaner may contain a combination of an anionic surfactant and an amphoteric surfactant that help provide a fast acting and stable foam.

In some examples, the drain cleaner also includes a sanitizing agent so that the drain cleaner both cleans the drain (e.g., removes build-up surface residue) and sanitizes the drain (e.g., kills microbes) during use. In contrast to applications that clean, rinse, and then sanitize a drain, a single application of the drain cleaner can simultaneously clean and sanitize the drain. When included, the sanitizing agent may be in the part that contains the hydrogen peroxide, in the part that contains the catalase, or in yet a third part that is physically separate from the first part and the second part. For example, the sanitizing agent may be provided separately from the catalase and at a different pH than the pH of the catalase. This may be useful in examples in which the pH required to maintain efficacy of the sanitizing agent causes deactivation of the catalase.

In one example, a foaming drain cleaner system is described that includes a first part that includes hydrogen peroxide and water and a second part that includes a catalase, an amylase, a protease, and an enzyme stabilizer. The foaming drain cleaner system also includes a surfactant present in at least one of the first part and the second part and specifies that the first part is separated from the second part so that the first part and the second part do not intermix.

In another example, a method is described that includes combining a first part that includes hydrogen peroxide and water with a second part that includes a catalase, an amylase, a protease, an enzyme stabilizer, and a surfactant so as to generate a cleaning foam.

In another example, a drain cleaner system is described that includes a first part that includes hydrogen peroxide and water and a second part that includes a catalase, an amylase, a protease, and an enzyme stabilizer. The drain cleaner system also includes a surfactant present in at least one of the first part and the second part and a sanitizing agent. The example specifies that the first part is separated from the second part so that the hydrogen peroxide and the catalase do not intermix.

In another example, a method is described that includes combining a sanitizing agent, a first part that includes hydrogen peroxide and water, and a second part that includes a catalase, an amylase, a protease, an enzyme stabilizer, and a surfactant so as to generate a cleaning foam.

The details of one or more examples are set forth in the accompanying drawings and the description below. Other features, objects, and advantages will be apparent from the description and drawings, and from the claims.

DETAILED DESCRIPTION

Figure 1:
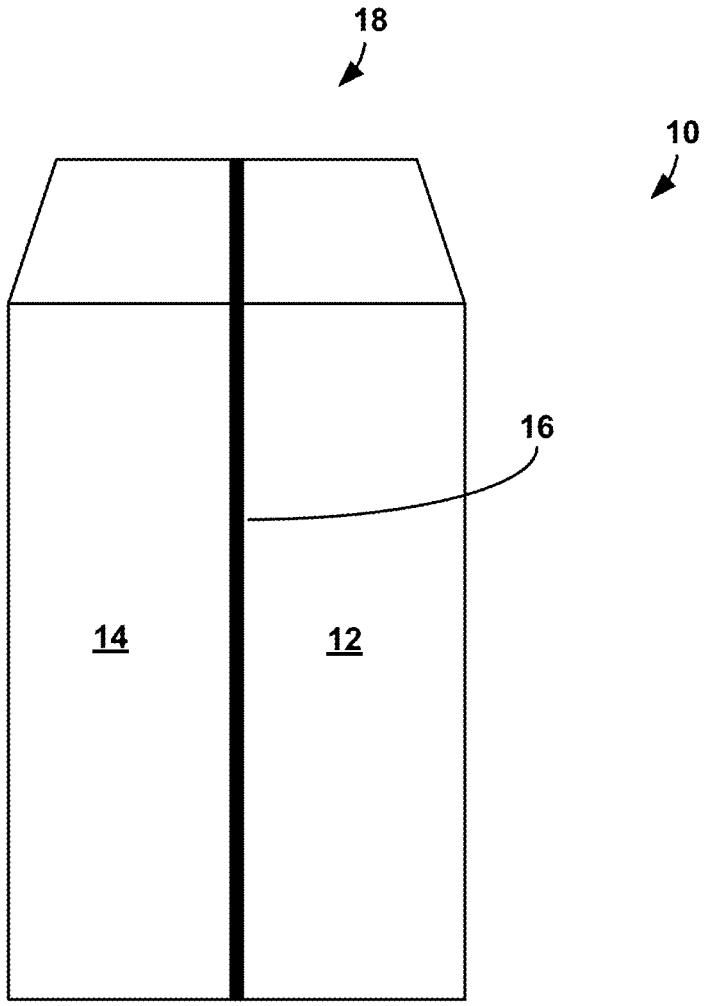
FIG. 1 is an illustration of an example container that may be used to store a drain cleaner in accordance with the disclosure.

In general, the disclosure describes chemical drain cleaner systems and compositions and methods of chemically cleaning a drain. In some examples, the chemical drain cleaner is provided as a system that includes a first compositional part physically separated from a second compositional part so that the parts do not intermix until deliberately combined. For example, the system can include two physically separate fluid containers or a single container divided into two or more different compartments so as to physically separate the first compositional part from the second compositional part. In use, the first part is combined with the second part, e.g., by simultaneously pouring both parts into a drain. Upon combining, the first compositional part and second compositional part react together and release oxygen. As the oxygen is generated, it can become entrapped in the other components of the drain cleaner, creating a dispersed foam media of expanded volume that coats the sidewalls of the drain with the drain cleaning composition.

In some examples, the first part includes hydrogen peroxide and water, and the second part includes catalase, amylase, protease, and an enzyme stabilizer. The drain cleaner may also include a surfactant present in either the first part, the second part, or both the first part and the second part. For example, the drain cleaner may include an anionic surfactant and an amphoteric surfactant. In some additional examples, the drain cleaner includes a sanitizing agent. The sanitizing agent may be present in the first part, the second part, or even yet a third part physically separate from the first part and the second part.

In use, combining the first part with the second part causes the catalase to catalyze decomposition of the hydrogen peroxide into water and gaseous oxygen. The gaseous oxygen may be entrapped by the other components of the drain cleaner such as, e.g., amylase, protease, surfactant, and sanitizer. For example, the surfactant may absorb at the surface of oxygen bubble walls, helping to generate the foam and prevent collapse of the foam into a liquid state. The surfactant may also help create network structures on the surface of the oxygen bubbles via hydrogen bonding that increase the surface viscosity of the foam and help to maintain the foam.

Hydrogen Peroxide

To provide a chemically self-foaming drain cleaner, the drain cleaner composition may include a source of oxygen, such as hydrogen peroxide ($H_2O_2$). Hydrogen peroxide provides the advantages of having a high ratio of active oxygen because of its low molecular weight (34.014 g/mole) and being compatible with numerous substances that can be treated using the drain cleaner composition, e.g., because it is a weakly acidic, clear, and colorless liquid. In addition, the decomposition products of hydrogen peroxide are generally compatible with substances and surfaces being treated. Hydrogen peroxide may decompose into water and gaseous oxygen during use of the drain cleaner. These decomposition products are generally compatible with metallic and polymeric surfaces (e.g., substantially noncorrosive and nondestructive) such as those used to fabricate drains.

In some examples, a different oxygen source is included in the drain cleaner in addition to or in lieu of hydrogen peroxide. Example oxygen sources that may be used in the drain cleaner include solutions of alkali-metal oxides, alkali-metal peroxides, alkali salts of percarbonate and persulfate, and organic peroxides. For example, organic peroxides such as dicumyl peroxide, dialkyl peroxides, urea peroxide, and the like may be included in the drain cleaner in addition to or in lieu of hydrogen peroxide to provide oxygen for chemically foaming the drain cleaner. For ease of description, the drain cleaner will be described as having a part including hydrogen peroxide, although other oxygen sources may be used in lieu of the hydrogen peroxide as described above.

When used, the hydrogen peroxide component of the drain cleaner may be provided as an aqueous solution physically separated from a decomposition agent that causes chemical decomposition of the hydrogen peroxide into water and oxygen. The concentration of the hydrogen peroxide in the aqueous solution may vary, e.g., depending on the intended application and the other chemical components included in the aqueous solution. In general, the amount of hydrogen peroxide in the aqueous solution may be effective so that, when the hydrogen peroxide solution is combined with a separate decomposition agent according to instructions for use of the drain cleaner, the hydrogen peroxide releases a sufficient amount of oxygen to completely fill a drain with foam. Additionally, in examples in which the drain cleaner includes a sanitizing agent, the concentration of the hydrogen peroxide solution may be sufficiently low so that the hydrogen peroxide does not adversely affect the sanitizing capabilities (e.g., antimicrobial activity) of the sanitizing agent.

In some examples, the drain cleaner includes one part comprising a hydrogen peroxide solution having a hydrogen peroxide concentration less than 50 weight percent such as, e.g., less than 30 weight percent, less than 15 weight percent, less than 10 weight percent, or less than or equal to 8 weight percent. For example, the hydrogen peroxide in the solution may range from approximately 10 weight percent to approximately 0.5 weight percent, such as from approximately 8 weight percent to approximately 3 weight percent. Increasing the concentration of the hydrogen peroxide may decrease the amount of hydrogen peroxide solution necessary to generate a sufficient amount of oxygen to adequately foam a drain during use. However, hydrogen peroxide concentrations above a certain level may require special storage and handling precautions, such as requiring use of special personal protective equipment (PPE). For instance, special PPE may be required in some applications where hydrogen peroxide is provided at a concentration greater than 8 weight percent. In these applications, the concentration of the hydrogen peroxide may be kept at or below 8 weight percent.

The part of the drain cleaner comprising hydrogen peroxide may include additional components (e.g., a surfactant), a peroxide stabilizer, and the like, with the remainder of the drain cleaner being water (e.g., deionized water) up to 100 weight percent. That is, after selecting the desired components for the drain cleaner part and identifying desired concentration levels for the selected components, the selected components may be combined with an amount of water suitable to obtain the desired concentrations for the selected components. In still other examples, the part containing hydrogen peroxide may not be an aqueous solution but may instead be a solid phase material (e.g., a powder, pellet, tablet, extruded block). In such examples, the concentration of the hydrogen peroxide in the drain cleaner part may be greater than when provided as a liquid, in some examples forming greater than 50 weight percent of the solid. During use of the solid phase material, a user can add water from an external source (e.g., a pressurized water main) to hydrate the solid phase material and form an in-situ solution.

Catalase

To decompose the hydrogen peroxide and generate gaseous oxygen for self-foaming the drain cleaner, the drain cleaner may include an oxygen source decomposition agent. In some examples, the decomposition agent is a catalase enzyme that catalyzes the decomposition of hydrogen peroxide to water and oxygen. The catalase enzyme may be physically separated from the hydrogen peroxide component of the drain cleaner during transport and storage and combinable with the hydrogen peroxide during use of the drain cleaner.

Any suitable catalase enzyme may be used in the drain cleaner to catalyze decomposition of the hydrogen peroxide. Sources of catalase enzymes include animal sources such as bovine catalase isolated from beef livers, fungal catalases isolated from fungi including *Penicillium chrysogenum, Penicillium notatum*, and *Aspergillus niger*, plant sources, bacterial sources such as *Staphylococcus aureus*, genetic variations and modifications thereof, and combinations. In general, the catalase enzyme used in the drain cleaner has a high ability to decompose hydrogen peroxide. In some examples, the catalase enzyme is capable of decomposing at least 10,000 weight ppm of hydrogen peroxide in 5 minutes so as to quickly release oxygen for foaming the drain cleaner composition. For example, the catalase enzyme may decompose at least 32,000 ppm of hydrogen peroxide to water and gaseous oxygen in 5 minutes so as to self-foam the drain cleaner composition.

When combined with hydrogen peroxide, the catalase can catalyze decomposition of the hydrogen peroxide via an exothermic reaction that generates heat. For example, when one part of the drain cleaner containing hydrogen peroxide is combined with another part of the drain cleaner containing catalase enzymes, the temperature of the combined parts may elevate to a temperature ranging from 25 degrees Celsius to 80 degrees Celsius, such as from 30 degrees Celsius to 60 degrees Celsius, or 40 degrees Celsius to 50 degrees Celsius. This temperature increase can be useful to help clean surfaces, e.g., by liquefying fat soils, activating enzymes, and increasing the rate of reactions that break down different soils.

In some applications, a drain cleaner is only used on an irregular basis. In these situations, the drain cleaner may be stored for an extended period of time before the different parts of the drain cleaner are combined to generate a foam cleaning composition. To help ensure that the drain cleaner remains effective and generates a suitable amount of foam during use, the catalase may exhibit shelf-life stability suitable for the expected shelf-life of the drain cleaner. In some examples, the catalase maintains at least 75 percent of its activity after being stored at a temperature of 40 degrees Celsius or greater for a period of at least four weeks.

The catalase used in the drain cleaner may include catalase enzymes tolerant to a pH exhibited by the part of the drain cleaner containing the catalase. In some examples, the pH of the part of the drain cleaner containing the catalase is controlled to help maintain the activity of the catalase. In other examples, the pH of the part of the drain cleaner containing the catalase is dictated by other chemical components included in the part. In these examples, the catalase may be selected to be compatible with the pH range required by the other chemical components. While the pH of the part of the drain cleaner containing the catalase may vary, e.g., depending on the specific chemical compounds selected for the drain cleaner, in some examples, the pH ranges from approximately 6 to approximately 12, such as approximately 7.5 to approximately 9.5. The catalase enzymes may exhibit have a broad spectrum of activity and a high tolerance for materials found in cleaning compositions like alkalinity, acidity, chelating agents, sequestering agents, and surfactants.

Commercially available catalases are available in liquid and spray dried forms and may or may not include additional ingredients to enhance the stability of the enzyme. Example catalases that may be used for the drain cleaner include, but are not limited to Terminox® ultra and Terminox® Supreme 1000BCU available from Novozymes, and Optimase® CL 100L and Optimase® CA 400L available from Genencor.

In some examples, the drain cleaner includes one part comprising an aqueous catalase enzyme solution having a catalase concentration ranging from approximately 1 weight percent to approximately 20 weight percent of the part such as, e.g., from approximately 3 weight percent to approximately 15 weight percent, or from approximately 5 weight percent to approximately 12 weight percent. The foregoing weight percentages may be calculated excluding the weight of water in the solution. For example, where the part of the drain cleaner containing the catalase includes added water, catalase, and optionally additional drain cleaner compounds, the concentration of the components may be calculated to exclude the weight of water by summing all components in the drain cleaner part except the water and then determining the weight percentages based on this sum. Such a calculation methodology may be useful because the drain cleaner may be provided at a variety of different concentration levels (e.g., super concentrate, concentrate, ready for use) by adjusting the amount of water in the drain cleaner.

As one example, the part of the drain cleaner containing the catalase may be provided as a concentrate where water ranges from approximately 40 weight percent to approximately 60 weight percent of the drain cleaner part. In such an example, the concentration of the catalase in the concentrate may range from approximately 4 weight percent to approximately 6 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of catalase in the use solution ranges from 0.0005 weight percent to 1 weight percent of the drain cleaner part, such as from 0.001 weight percent to 0.1 weight percent. In other examples, the catalase may be provided at these concentration ranges in the drain cleaner part without requiring the user to add additional water. In such examples, the drain cleaner part may be provided as a pre-diluted, ready-to-use formulation. It should be appreciated that the foregoing concentrations and concentration ranges are merely examples, and other catalase concentrations may be used.

Surfactant

The drain cleaner composition may also include a surfactant. The surfactant, which may be a mixture or combination of multiple surfactants, may provide, e.g., surface tension modification, cleaning properties, and foam building and maintaining properties to the drain cleaner. The surfactant may trap gaseous oxygen released by decomposition of the hydrogen peroxide to rapidly build the foam. The surfactant may help build a foam that spreads evenly over the surface of the drain to which the drain cleaner is applied. The surfactant may also help stabilize and maintain the foam, e.g., so that the foam does break apart over a given period of time.

When used, the surfactant may be included in the part of the drain cleaner that includes the hydrogen peroxide, the part of the drain cleaner that includes the catalase, or both parts of the drain cleaner. The surfactant may be selected to be compatible with other chemical compounds in the part of the drain cleaner in which the surfactant is incorporated. Examples of different surfactants that may be included in the drain cleaner include water soluble or water dispersible nonionic, semi-polar nonionic, anionic, cationic, amphoteric, and zwitterionic surfactants, and combinations thereof. The particular surfactant or combination of surfactants chosen for use in the drain cleaner may depend, e.g., on the foam building and maintaining properties of the surfactant, use pH, use temperature, and the type of soil expected to be cleaned. Surfactants incorporated into the drain cleaner may be compatible with enzymes in the drain cleaner and be selected so as to not inhibit the activity of the enzymes. For example, when proteases and amylases are employed in the drain cleaner, the surfactant may be free of peptide and glycosidic bonds.

In one example, the drain cleaner includes an anionic surfactant. A surfactant may be categorized as anionic because the charge on the hydrophobe is negative (although the hydrophobic section of the molecule may carry no charge unless the pH is elevated to neutrality or above, such as in the case of a carboxylic acids). Carboxylate, sulfonate, sulfate and phosphate are examples of the polar (hydrophilic) solubilizing groups found in many anionic surfactants. The cations (counter ions) associated with these polar groups may include sodium, lithium, and/or potassium to impart water solubility; ammonium and/or substituted ammonium ions to provide both water and oil solubility; and, calcium, barium, and/or magnesium to promote oil solubility.

Anionic surfactants that may be used in the drain cleaner include linear and branched primary and secondary alkyl sulfates, alkyl ethoxysulfates, fatty oleyl glycerol sulfates, alkyl phenol ethylene oxide ether sulfates, the C5-C17 acyl-N—(C1-C4 alkyl) and —N—(C1-C2 hydroxyalkyl) glucamine sulfates, and sulfates of alkylpolysaccharides such as the sulfates of alkylpolyglucoside. In some examples, the anionic surfactant is a synthetic, water soluble anionic surfactant compound that includes the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives. Other anionic surfactants that may be used in the drain cleaner include olefin sulfonates, such as long chain alkene sulfonates, long chain hydroxyalkane sulfonates or mixtures of alkenesulfonates and hydroxyalkane-sulfonates.

In one example, the drain cleaner includes an anionic surfactant where the anionic group of the surfactant includes one of a sulfate, sulfonate, and benzene sulfonate, phosphate, carboxylate, and sulfosuccinate. For example, the anionic surfactant may include an anionic group that is a sulfate (e.g., a salt of a sulfate ester of a linear aliphatic alcohol). Example cations for the anionic surfactant may include one of potassium, ammonium, substituted ammonium salts, sodium, and magnesium. Representative anionic surfactants include sodium dodeccylbenzene sulfonate, sodium lauryl sulfate, magnesium lauryl sulfate, and sodium and magnesium undecyl sulfate.

When an alkyl sulfate anionic surfactant is used, the alkyl may, in different examples, be linear, branched, or include both linear and branched components. In some examples, however, the alkyl group is linear (e.g., straight) and not branched. A surfactant with a linear alkyl group may provide a closer-packed arrangement of surfactant molecules on the surface than a branched alkyl group, leading to an increase in foam stability. In such examples, the polar group in the anionic surfactant may be attached to the terminal carbon atom (1-position) and the alkyl group extending from the terminal position may be 8 to 20 carbon atoms in length, such as 10 to 18 carbon atoms in length, or 11 to 16 carbon atoms in length. For example, as discussed above, the alkyl group in the surfactant may be a straight chain alkyl group, substituted in the 1-position, that contains twelve carbon atoms (i.e., the lauryl group).

In some examples, the drain cleaner includes an amphoteric surfactant in addition to or in lieu of an anionic surfactant. Amphoteric surfactants can be broadly described as derivatives of aliphatic secondary and tertiary amines in which the aliphatic radical may be straight chain or branched and where one of the aliphatic substituents contains from about 8 to 18 carbon atoms and one contains an anionic water solubilizing group, e.g., carboxy, sulfo, sulfato, phosphate, or phosphono. Amphoteric surfactants generally are subdivided into two major classes. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants may fit into both classes.

Examples of imidazoline-derived amphoterics that may be incorporated into the drain cleaner include, for example: cocoamphopropionate, cocoamphocarboxy-propionate, cocoamphoglycinate, cocoamphocarboxy-glycinate, cocoamphopropyl-sulfonate, and cocoamphocarboxy-propionic acid. Examples of N-alkylamino acid ampholytes that may be incorporated into the drain cleaner include, for example, alkyl beta-amino dipropionates, $RN(C_2H_4COOM)_2$ and $RNHC_2H_4COOM$. In these, R may be a acyclic hydrophobic group containing from about 8 to about 18 carbon atoms, and M a cation to neutralize the charge of the anion. In one example, the drain cleaner includes N-alkyl(C12-14)dimethylamine oxide.

In different examples, the surfactant may be present in liquid form in the drain cleaner or as a solid. When used, the amount of surfactant incorporated into the drain cleaner may be effective to provide a foam that completely fills a drain and fully contact the sidewalls of the drain. The amount of surfactant incorporated into the drain cleaner may also be effective to maintain the foam in contact with the sidewalls of the drain for a given period of time such as, e.g., at least one minute, at least three minutes, at least five minutes. In some examples, the drain cleaner includes one part comprising an aqueous catalase enzyme solution that further includes the surfactant. In such examples, the surfactant concentration may range from 1 weight percent to 50 weight percent of the part such as, e.g., from 5 weight percent to 40 weight percent, or from 10 weight percent to 30 weight percent. The foregoing weight percentages may be calculated excluding the weight of water in the solution. For example, where the part of the drain cleaner containing the surfactant includes added water, catalase, surfactant, and optically additional drain cleaner compounds, the concentration of the components may be calculated to exclude the weight of water by summing all components in the drain cleaner part except the water and then determining the weight percentages based on this sum.

As one example, the part of the drain cleaner containing the surfactant may be provided as a concentrate where water ranges from approximately 40 weight percent to approximately 60 weight percent of the drain cleaner part. In such an example, the concentration of the surfactant in the concentrate may range from 10 weight percent to 20 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of surfactant in the use solution ranges from 0.001 weight percent to 1 weight percent, such as 0.01 weight percent to 0.6 weight percent, or approximately 0.45 weight percent to approximately 0.55 weight percent of the drain cleaner part. In other examples, the surfactant may be provided at these concentration ranges in the drain cleaner part without requiring the user to add additional water. In such examples, the drain cleaner part may be provided as a pre-diluted, ready-to-use formulation. In still other examples, the surfactant may not be included in a part that contains catalase enzymes but may instead be included in a part that contains hydrogen peroxide.

The weight percentage surfactant included in a drain cleaner part may be the combined weight of all surfactants included in the part (e.g., in instances in which the part includes more than one surfactant). For instance, in some applications, the drain cleaner includes both an anionic surfactant and an amphoteric surfactant. An anionic surfactant may provide flash foaming activity for the drain cleaner. This may be useful to ensure that the drain cleaner begins building foam quickly in use, e.g., so that the drain cleaner does not discharge from a drain before generating enough foam to block the drain. An amphoteric surfactant may provide foam stability for the drain cleaner. This may be useful to ensure that the foam remains in contact with the sidewall of the drain with a sufficient period of time to provide cleaning and/or sanitizing action. While the relative amount of the amphoteric surfactant and anionic surfactant can vary, in some examples, a weight ratio of the amphoteric surfactant divided by the anionic surfactant ranges from 1 to 50 such as, e.g., from approximately 5 to approximately 25, or from approximately 10 to approximately 15. Such ratios may provide an effective balance between flash foaming requirements for the drain cleaner and foam stability. The ratio can be calculated by dividing the weight of the amphoteric surfactant by the weight of the anionic surfactant.

Sanitizer

To sanitize a drain surface while also cleaning the drain surface, the drain cleaner may include a sanitizing agent. The sanitizing agent may include one or more compounds that function to provide anti-microbial activity to the drain cleaner. That is, when applied to a surface of a drain, the sanitizing agent may function to kill microbes on the surface of the drain. Microbes may be present on the drain surface in the form of a biofilm that results from bacterial growth within the drain. Such bacteria can grow in the drain when organic matter (e.g., proteins, fats, carbohydrates) is flushed down the drain during normal use of the drain. In addition to providing generally unsanitary conditions, the bacterial growth can create odors that emanate from the drain. Further, the bacterial growth may act as an attractant for undesirable pests such as drain flies.

To function as a suitable sanitizer in the drain cleaner, the sanitizing agent may be effective to cause a reduction in the population of bacteria or spores of a bacteria species that may be present in a drain. For example, when the sanitizing agent is applied to sidewalls of a drain during use of the drain cleaner—for example, so that the drain cleaner chemically self-foams and distributes the contents of the drain cleaner against the sidewalls of the drain—the sanitizing agent may be effective to cause a greater than 90% reduction (1-log order reduction) in the population of bacteria or spores of a bacteria species on the surface of the drain. In some examples, the sanitizing agent is effective to cause a greater than 99% reduction (2-log order reduction) in the population of bacteria or spores of a bacteria species on the surface of the drain after being applied by chemically self-foaming the drain cleaner composition and allowing the composition to reside on the surface of the drain sidewalls for at least 5 minutes, such as a greater than 99.9% reduction (3-log order reduction) in the population of bacteria or spores of the bacteria species after at least 5 minutes, or a greater than 99.99% reduction (4-log order reduction) in the population of bacteria or spores of the bacteria species after at least 5 minutes.

In one example, the drain cleaner includes a sanitizing agent effective (e.g., compositionally and/or concentration-wise) to cause a greater than 99% reduction (2-log order reduction) in a population of bacteria that includes *Staphylococcus aureus, Enterobacter aerogenes*, and *Listeria monocytogenes*, such as a greater than 99.9% reduction (3-log order reduction) in the population of these bacteria, or a greater than 99.99% reduction (4-log order reduction) in the population of these bacteria. In this example, the bacteria reduction may be determined by comparing the bacteria count on a surface before application of the drain cleaner to the bacteria count on the same surface after the foamed drain cleaner is allowed to reside in contact with the surface for a given period of time, such as greater than 30 seconds, greater than 1 minute, greater than 3 minutes, or greater than 5 minutes.

A variety of different compounds may function as a sanitizing agent in the drain cleaner. As one example, the drain cleaner includes a peracid that function as a sanitizing agent. A peracid may be any acid formed by replacing an organic hydroxyl group (—OH) with the peroxy group (—OOH). For example, a peracid may be the oxidized derivative of a carboxylic acid—such as peracetic acid (CH3COOOH) is the oxidized derivative of acetic acid (CH3COOH). The term "peracid" generally includes peroxyacid, percarboxylic acid and peroxoic acid.

Peracid acids that may be used in the drain cleaner as a sanitizing agent include peracids having carbon chains two to eighteen carbons in length (i.e., a C2-C18 peracid), such as C2 (peracetic) acid and C8 (peroctanoic) acid. In some examples, the drain cleaner includes a peracid having the general formula R(CO3H)n, where R is an alkyl, arylalkyl, cycloalkyl, aromatic or heterocyclic group, and n is one or two. Example peracids that may be used include peroxyformic, peroxyacetic, peroxypropionic, peroxybutanoic, peroxypentanoic, peroxyhexanoic, peroxyheptanoic, peroxyoctanoic, peroxynonanoic, peroxydecanoic, peroxylactic, peroxymaleic, peroxyascorbic, peroxyhydroxyacetic, peroxyoxalic, peroxymalonic, peroxysuccinic, peroxyglutaric, peroxyadipic, peroxypimelic and peroxysubric acid and mixtures thereof as well as other peracids known to those of skill in the art.

In some additional examples, the drain cleaner includes an amine or amine derivative having antimicrobial activity in an amine part. Examples of amines or amine derivatives having antimicrobial activity may include the reaction product of alkylpropylene diamine with glutamic acid called GLUCOPROTAMIN, N-cocotrimethylenediamine, dodecylmorpholine-N-oxide, alkylpropylenediamine, and N-Alkyl(C12-14) dimethylamine oxide, commercially available as Lonzabac® 12 (e.g., Lonzabac 12.100).

Accordingly, in one example, the drain cleaner includes an alkyl amine as a sanitizing agent. The amine may be a primary, secondary, or tertiary amine. An example tertiary alkyl amine that can be used in the drain cleaner is an amine with the general formula:

$$R—N[(CH_2)_n—NH_2]_2$$

where R is a $C_4$-$C_{20}$ alkyl, such as a $C_6$-$C_{18}$ alkyl, a $C_5$-$C_{10}$ alkyl, a $C_6$-$C_{10}$ cycloalkyl, a $C_7$-$C_{10}$ aryl alkyl, such as a $C_7$ aryl alkyl, a $C_6$-$C_{14}$ aryl group, and where n is a number ranging from 2 to 10, such as 2 to 6, or 2 or 3. In some examples, R is a $C_6$-$C_{18}$, alkyl group, such as a dodecyl or tallow fat alkyl group.

When used, the sanitizing agent may be incorporated into a part of the drain cleaner that includes the hydrogen peroxide, a part of the drain cleaner that includes the catalase, or yet a third part that is physically separate from the other two parts of the drain cleaner. While incorporating the sanitizing agent into one of the other drain cleaner parts reduces the number of different compositional parts that need to be combined together during use of the drain cleaner, in some examples, the sanitizing agent may need a storage/compositional environment that is dissimilar from what is provided by the parts containing the hydrogen peroxide and/or catalase.

As one example, the catalase may need to be stored at a comparatively acidic pH to maintain suitable activity of the catalase over the expected shelf-life of the drain cleaner. By contrast, the sanitizing agent may need to be stored at a comparatively basic pH to maintain the sanitizing efficacy of the agent over the expected shelf-life of the drain cleaner. For example, the part of the drain cleaner containing the catalase may be controlled to have a pH less than 9.0, such as less than 8.5, less than 8.0, less than 7.5, less than 7.0, from approximately 5.0 to approximately 9.0, or from approximately 6.0 to approximately 8.0. Such a pH may help ensure that the catalase remains sufficiently active over an expected shelf-life of the drain cleaner (e.g., at least four weeks) so that, when the catalase is combined with the hydrogen peroxide, the combination generates a robust foam that completely fills a drain. On the other hand, a part of the drain cleaner containing the sanitizing agent may be controlled to have a pH greater than 8.0, such as greater than 8.5, greater than 9.0, greater than 9.5 (e.g., approximately 9.6 or greater), or from approximately 9.0 to approximately 13.0. Such a pH may help ensure that the sanitizing agent remains sufficiently active over an expected shelf-life of the drain cleaner so that the sanitizing agent suitably reduces a bacteria population on a drain surface when the sanitizing agent is combined, e.g., with hydrogen peroxide and catalase to generate the drain cleaner foam. In these examples, the sanitizing agent may be provided separately from the catalase and hydrogen peroxide components, e.g., in a system that allows the sanitizing agent to be simultaneously combined with the catalase and hydrogen peroxide during use of the drain cleaner.

While the sanitizing agent can be separated from the catalase and hydrogen peroxide for transport and storage of the drain cleaner, in other examples, the sanitizing agent is incorporated into the part of the drain cleaner that contains the catalase. The specific pH selected for the drain cleaner part in such an example may vary depending on the type of sanitizing agent and catalase selected. However, in some examples, the pH is controlled to range from approximately 7.8 to approximately 10.5, such as from approximately 8.2 to approximately 9.5, or approximately 8.7 to approximately 9.2. Such a pH range may balance the pH environment best suited for the catalase with the pH environment best suited for the sanitizing agent.

The concentration of the sanitizing agent in the drain cleaner may be effective to achieve a desired bacterial reduction, as discussed above. In examples in which the sanitizing agent is included in the drain cleaner part containing the catalase, the sanitizing agent may range from 0.01 weight percent to 15 weight percent of the part such as, e.g., from 0.1 weight percent to 10 weight percent, or from 1 weight percent to 5 weight percent. The foregoing weight percentages may be calculated excluding the weight of water in the solution. For example, where the part of the drain cleaner containing the sanitizing agent includes added water, catalase, and optically additional drain cleaner compounds, the concentration of the components may be calculated to exclude the weight of water by summing all components in the drain cleaner part except the water and then determining the weight percentages based on this sum.

In examples in which the sanitizing agent is provided in a drain cleaner part separate from parts containing catalase and hydrogen peroxide, the concentration of the sanitizing agent may be sufficient so that, when the part containing sanitizing agent is combined with the part containing catalase, the sanitizing agent ranges from 0.01 weight percent to 15 weight percent of the weight of the combined part such as, e.g., from 0.1 weight percent to 10 weight percent, or from 1 weight percent to 5 weight percent. The foregoing weight percentages may be calculated excluding the weight of water in the combined parts. For example, where the part of the drain cleaner containing the sanitizing agent includes added water and the part of the drain cleaner containing catalase includes added water, the concentration of the components may be calculated to exclude the weight of water by summing all components in the two drain cleaner parts except the water and then determining the weight percentages based on this sum.

In one example, the part of the drain cleaner containing the catalase also includes the sanitizing agent, and the drain cleaner part is provided as a concentrate where water ranges from approximately 40 weight percent to approximately 60 weight percent of the drain cleaner part. In such an example, the concentration of the sanitizing agent in the concentrate may range from 0.75 weight percent to 1.25 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of sanitizing agent in the use solution ranges from approximately 0.0001 weight percent to approximately 0.5 weight percent of the drain cleaner part, such as from 0.001 weight percent to 0.1 weight. In other examples, the sanitizing agent may be provided at these concentration ranges in the drain cleaner part without requiring the user to add additional water. In such examples, the drain cleaner part may be provided as a pre-diluted, ready-to-use formulation. In still other examples, the sanitizing agent may be provided in a drain cleaner part separate from the part containing catalase so that, when the part containing the sanitizing agent is combined with the part containing catalase to form a use solution, the sanitizing agent in the use solution ranges from approximately 0.0001 weight percent to approximately 0.5 weight percent of the combined weight of the drain cleaner parts, such as from 0.001 weight percent to 0.1 weight percent of the combined weight.

Enzymes

The drain cleaner can include one or more enzymes, which can provide desirable activity for removal of protein-based, carbohydrate-based, or triglyceride-based soils from drains. Although not limiting, enzymes that can be incorporated into the drain cleaner may act by degrading or altering one or more types of soil residues encountered on a surface of a drain, thus removing the soil or making the soil more removable by a surfactant or other component of the drain cleaner. Both degradation and alteration of soil residues can improve removal by reducing the physicochemical forces binding the soil to the surface being cleaned, e.g., so the soil becomes more water soluble. Enzymes that may be used in the drain cleaner include, e.g., a hydrolase such as a protease, an amylase, a lipase, or a combination thereof.

In one example, the drain cleaner includes a protease. Proteases can cleave complex, macromolecular protein structures present in soil residues into simpler short chain molecules which are, of themselves, more readily desorbed from surfaces, solubilized or otherwise more easily removed by cleaning foam containing the proteases. Proteases are generally classified into serine proteases, thiol proteases, carboxyl proteases and metal proteases, depending upon their active sites. They may also be classified into three of microorganism-, plant- and animal-derived proteases, depending upon their origins. Microorganism-derived proteases are further classified into bacteria-, actinomycete-, mold- and yeast-derived proteases.

Any suitable protease may be included in the drain cleaner. In different examples, the protease included in the drain cleaner can be derived from a plant, an animal, or a microorganism. In one example, the drain cleaner includes a protease derived from a microorganism, such as a yeast, a mold, or a bacterium. For example, the drain cleaner may include a serine protease, e.g., derived from a strain of *Bacillus* such as *Bacillus subtilis* or *Bacillus licheniformis*. These proteases can include native and recombinant subtilisins. The protease can be purified or a component of a microbial extract, and either a wild type or variant (either chemical or recombinant). In some examples, the protease is selected so that it is active at a pH of about 6 to about 12 and at temperatures in a range from about 20° C. to about 80° C.

Examples of commercial available proteases that may be incorporated in the drain cleaner include those sold under the trade names Alcalase®, Savinase® (e.g., Savinase® Ultra 16L), Primase®, Durazym®, Esperase®; Maxatase®, Maxacal®, Maxapem®, Opticlean® Optimase®, Purafect®, and Purafect OX. Mixtures of different protease enzymes may also be incorporated in the drain cleaner. Further, while various specific enzymes have been described, it should be appreciated that any protease which can confer the desired proteolytic activity to the composition may be used and the disclosure is not limited to any specific protease.

When used, the protease may be incorporated into the drain cleaner in an amount sufficient to yield effective cleaning and removal of protein soil structures, e.g., of the type that may accumulate on a drain surface. In some examples, the drain cleaner includes one part comprising an aqueous catalase enzyme solution that further includes the protease. In such examples, the protease concentration may range from 0.0001 weight percent to 10 weight percent of the part such as, e.g., from 0.05 weight percent to 5 weight percent, or from 0.1 weight percent to 2 weight percent. The foregoing weight percentages may be calculated excluding the weight of water in the solution. For example, where the part of the drain cleaner containing the protease includes added water, catalase, and optionally additional drain cleaner compounds, the concentration of the components may be calculated to exclude the weight of water by summing all components in the drain cleaner part except the water and then determining the weight percentages based on this sum.

As one example, the part of the drain cleaner containing the protease may be provided as a concentrate where water ranges from approximately 40 weight percent to approximately 60 weight percent of the drain cleaner part. In such an example, the concentration of the protease in the concentrate may range from 0.25 weight percent to 0.75 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of protease in the use solution ranges from 0.0005 weight percent to 0.2 weight percent, such as from 0.001 weight percent to 0.02 weight percent. In other examples, the protease may be provided at these concentration ranges in the drain cleaner part without requiring the user to add additional water. In such examples, the drain cleaner part may be provided as a pre-diluted, ready-to-use formulation.

In addition to or in lieu of a protease, the drain cleaner may include an amylase. An amylase enzyme can digest starch molecules present in soil residues into simpler short chain molecules (e.g., simple sugars) which are, of themselves, more readily desorbed from surfaces, solubilized or otherwise more easily removed by the cleaning foam containing the proteases. An amylase included in the drain cleaner can be derived from a plant, an animal, or a microorganism. In one example, the drain cleaner includes an amylase derived from a microorganism, such as a yeast, a mold, or a bacterium. For example, the drain cleaner may include an amylase derived from a *Bacillus*, such as *B. licheniformis, B. amyloliquefaciens, B. subtilis*, or *B. stearothermophilus*. The amylase can be purified or a component of a microbial extract, and either a wild type or variant (either chemical or recombinant). In some examples, the drain cleaner includes an alpha amylase (α-amylase).

Examples of amylase enzymes that may be employed in the drain cleaner include those sold under the trade name Rapidase by Gist-Brocades® (Netherlands), Termamyl®, Fungamyl®, Duramyl®, or Stainzyme® Plus by Novo, Purastar STL or Purastar OXAM by Genencor, and the like. A mixture of amylases can also be used. The amylase enzymes may have activity in the pH range of about 6-12 and at temperatures from about 20° C. to 80° C.

When used, the amylase may be incorporated into the drain cleaner an amount sufficient to yield effective cleaning and removal of starch soil structures, e.g., of the type that may accumulate on a drain surface. In some examples, the drain cleaner includes one part comprising an aqueous catalase enzyme solution that further includes the amylase. In such examples, the amylase concentration may range from 0.0001 weight percent to 10 weight percent of the part such as, e.g., from 0.05 weight percent to 5 weight percent, or from 0.1 weight percent to 2 weight percent. The foregoing weight percentages may be calculated excluding the weight of water in the solution. For example, where the part of the drain cleaner containing the amylase includes added water, catalase, and optically additional drain cleaner compounds, the concentration of the components may be calculated to exclude the weight of water by summing all components in the drain cleaner part except the water and then determining the weight percentages based on this sum.

As one example, the part of the drain cleaner containing the amylase may be provided as a concentrate where water ranges from approximately 40 weight percent to approximately 60 weight percent of the drain cleaner part. In such an example, the concentration of the amylase in the concentrate may range from 0.25 weight percent to 0.75 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of amylase in the use solution ranges from 0.0005 weight percent to 0.2 weight percent, such as from 0.001 weight percent to 0.02 weight percent. In other examples, the amylase may be provided at these concentration ranges in the drain cleaner part without requiring the user to add additional water. In such examples, the drain cleaner part may be provided as a pre-diluted, ready-to-use formulation.

Enzyme Stabilizer

The drain cleaner can include an enzyme stabilizer that helps stabilize different enzymes in the cleaner, such as catalase, protease, and amylase. The enzyme stabilizer may slow mobility of the enzymes, keeping the enzymes active for a longer period of time than if the enzyme stabilizer were not present in the cleaner. In addition to stabilizing enzymes, the enzyme stabilizer may also function as a filler in the drain cleaner by displacing water from the cleaner, e.g., both in a concentrate form and ready-to-use form. In such examples, the enzyme stabilizer may be a non-aqueous filler that is compatible with the enzyme, maintains phase stability, and optionally provides anti-freeze properties. Examples of enzyme stabilizers that may be included in the drain cleaner are polyhydric alcohols, for example, glycerol, sorbitol, mannitol, erythritol, dulcitol and inositol. A polyhydric alcohol can exhibit high activity for stabilizing an enzyme and a low activity for weakening the enzymatic effects of the enzyme.

When used, a polyhydric alcohol, which may also be referred to as a polyol, may have a carbon chain 2 to 6 carbon atoms in length, such as two or three carbons in length, and include two or three hydroxyl groups. Specific examples of such polyhydric alcohols include 1,2-propane diol (propylene glycol), 1,3-propane diol, and ethylene glycol. The use of the enzyme stabilizer can both stabilize enzymes in the drain cleaner to increase shelf-life and provide a more dilute concentration of the enzymes, e.g., to facilitate more accurate dosing by dispensing a greater volume during formulation of the drain cleaner.

The amount of enzyme stabilizer added to the drain cleaner may be effective to improve enzyme stabilization as compared to if the enzyme stabilizer is not present. If the concentration of the enzyme stabilizer is too low, the enzyme stabilizing effect may not be obtained. On the other hand, if the concentration is too high, the cleaning effect of the drain cleaner may be reduced.

In some examples, the drain cleaner includes one part comprising an aqueous catalase enzyme solution that further includes the enzyme stabilizer. In such examples, the enzyme stabilizer concentration may range from 1 weight percent to 80 weight percent of the part such as, e.g., from 15 weight percent to 70 weight percent, or from 30 weight percent to 60 weight percent. The foregoing weight percentages may be calculated excluding the weight of water in the solution. For example, where the part of the drain cleaner containing the enzyme stabilizer includes added water, catalase, and optically additional drain cleaner compounds, the concentration of the components may be calculated to exclude the weight of water by summing all components in the drain cleaner part except the water and then determining the weight percentages based on this sum.

As one example, the part of the drain cleaner containing the enzyme stabilizer may be provided as a concentrate where water ranges from approximately 40 weight percent to approximately 60 weight percent of the drain cleaner part. In such an example, the concentration of the enzyme stabilizer in the concentrate may range from 20 weight percent to 40 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of enzyme stabilizer in the use solution ranges from 0.1 weight percent to 4 weight percent, such as from 0.5 weight percent to 2 weight percent. In other examples, the enzyme stabilizer may be provided at these concentration ranges in the drain cleaner part without requiring the user to add additional water. In such examples, the drain cleaner part may be provided as a prediluted, ready-to-use formulation.

Additional Components

The drain cleaning composition can include any of a variety of components typically included in enzyme or other cleaning compositions. Such components may include, but are not limited to, a chelating or sequestering agent, a builder, a solubility modifier, additional fillers, anti-redeposition agent, a wetting agent, and/or a hydrotrope. Additionally, the drain cleaner may include pigments or dyes, fragrance additives, and/or other aesthetic enhancing agents. When used, the component(s) may be included in the drain cleaner part containing the hydrogen peroxide, the drain cleaner part containing the catalase, both drain cleaner parts, or yet another part (e.g., a drain cleaner part containing sanitizing agent).

As one example, the drain cleaning composition may include a thickener, which may increase the viscosity of a compositional part (e.g., the compositional part containing catalase) and, in some examples, help act as an enzyme stabilizer by immobilizing enzyme movement in the more viscous fluid. Example thickeners that may be used include, but are not limited to, natural polysaccharides such as xanthan gum, carrageenan and the like; or cellulosic type thickeners such as carboxymethyl cellulose, and hydroxymethyl-, hydroxyethyl-, and hydroxypropyl cellulose; or, polycarboxylate thickeners such as high molecular weight polyacrylates or carboxyvinyl polymers and copolymers; or, naturally occurring and synthetic clays.

As another example, the drain cleaner may include a water conditioning agent. When the drain cleaner composition is prepared or applied in hard water, which typically contains both calcium and magnesium ions, the hard water may inhibit foaming action of the drain cleaner. A water conditioning agent may help enhance the effectiveness of the drain cleaner at foaming and cleaning. For example, a water conditioning agent may inactivate water hardness and prevent calcium and magnesium ions from interacting with soils, surfactants, and other components of the drain cleaner. A water conditioning agent may condition water in different mechanisms, such as sequestration, ion-exchange, and dispersion.

In one example, the drain cleaner includes an organic carboxylic acid or salts thereof as a water conditioning agent, such as polycarboxylic acid water conditioning agent. Examples of polycarboxylic acids that may be used include dicarboxylic acids dicarboxylic acids substituted by CH3-(CH2)n, where n is an integer of value of at least 1, CH3, OH, NH2, Cl, Br, F, I, OR", NHR", NR"2, NO2, SO3, cyclic rings like cyclopentane, cyclohexane, phenyl, benzyl, or a mixture of these substituents; wherein R" is selected from saturated or unsaturated alkyl chain. Examples of such substituted dicarboxylic acids are phtalic acid, isophtalic acid, terephtalic acid, malic acid, fumaric acid, tartaric acid, or mixtures thereof. The substituents may also be anywhere in the alkyl chain attached to the acidic functions. The alkyl chains can be saturated or non-saturated.

Other polycarboxylic acids that may be used as a water conditioning agent include polycarboxylic acids containing three carboxy groups and include, for example, water-soluble citric acid, aconitric, and citraconic acid, as well as succinic derivatives such as the carboxymethyloxysuccinic, lactoxysuccinic, aminosuccinic, and oxypolycarboxylic materials such as 2-oxa-1,1,3-propane tricarboxylic described.

Other polycarboxylic acids that may be used as a water conditioning agent include polycarboxylic acids containing four carboxy groups and include, for example, oxydisuccinic, 1,1,2,2-ethane tetracarboxylic, 1,1,3,3-propane tetracarboxylic, and 1,1,2,3-propane tetracarboxylic.

When used, the water conditioning agent may be incorporated into the drain cleaner an amount sufficient to yield effective water conditioning, e.g., so as to prevent deactivation of the drain cleaner when used with hard water. In some examples, the drain cleaner includes one part comprising an aqueous catalase enzyme solution that further includes the water conditioning agent. In such examples, the water conditioning agent concentration may range from 0.0001 weight percent to 10 weight percent of the part such as, e.g., from 0.05 weight percent to 5 weight percent, or from 0.1 weight percent to 1 weight percent. The foregoing weight percentages may be calculated excluding the weight of water in the solution. For example, where the part of the drain cleaner containing the water conditioning agent includes added water, catalase, and optically additional drain cleaner compounds, the concentration of the components may be calculated to exclude the weight of water by summing all components in the drain cleaner part except the water and then determining the weight percentages based on this sum.

As one example, the part of the drain cleaner containing the water conditioning agent may be provided as a concentrate where water ranges from approximately 40 weight percent to approximately 60 weight percent of the drain cleaner part. In such an example, the concentration of the water conditioning agent in the concentrate may range from 0.1 weight percent to 0.15 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of water conditioning agent in the use solution is less than 0.0005 weight percent. In other examples, the water conditioning agent may be provided below this concentration range in the drain cleaner part without requiring the user to add additional water. In such examples, the drain cleaner part may be provided as a pre-diluted, ready-to-use formulation.

As another example, the drain cleaner may include a pH buffer, which may also be referred to as an alkalinity source depending on the application. Examples of suitable pH buffers that may be used in the drain cleaner include, but are not limited to, alkali metal carbonates and alkali metal hydroxides. Exemplary alkali metal carbonates that can be used include, for example: sodium or potassium carbonate, bicarbonate, sesquicarbonate, and mixtures thereof. Exemplary alkali metal hydroxides that can be used include, for example: sodium, lithium, or potassium hydroxide. In addition to a first pH buffer, the drain cleaner may include a secondary pH buffer. Examples of useful secondary pH buffers include, for example: metal silicates such as sodium or potassium silicate or metasilicate; metal carbonates such as sodium or potassium carbonate, bicarbonate, sesquicarbonate; metal borates such as sodium or potassium borate; and ethanolamines and amines.

An effective amount of one or more of the pH buffers may be used to achieve a desired pH for the drain cleaner (e.g., a pH for one or more parts of the drain cleaner and/or a pH of the drain cleaner once the different parts are combined). For example, an effective amount of one or more of the pH buffers may be used to achieve a pH ranging from approximately 8 to approximately 10. When the drain cleaner has a pH of between about 8 and about 10, it can be considered mildly alkaline, and when the pH is greater than about 12, the drain cleaner can be considered caustic. In general, it may be safer to provide the drain cleaner as a mildly alkaline cleaning composition as opposed to a more caustic composition. In some circumstances, the drain cleaner may provide a use composition that is effective at pH levels below about 8. In such compositions, an alkaline pH buffer may be omitted and additional pH adjusting agents may be used to provide the use composition with the desired pH.

In some examples, the drain cleaner includes one part comprising an aqueous catalase enzyme solution that further includes the pH buffer. In such examples, the pH buffer concentration may range from 0.01 weight percent to 20 weight percent of the part such as, e.g., from 0.1 weight percent to 15 weight percent, or from 1 weight percent to 10 weight percent. The foregoing weight percentages may be calculated excluding the weight of water in the solution. For example, where the part of the drain cleaner containing the pH buffer includes added water, catalase, and optically additional drain cleaner compounds, the concentration of the components may be calculated to exclude the weight of water by summing all components in the drain cleaner part except the water and then determining the weight percentages based on this sum.

As one example, the part of the drain cleaner containing the pH buffer may be provided as a concentrate where water ranges from approximately 40 weight percent to approximately 60 weight percent of the drain cleaner part. In such an example, the concentration of the pH buffer in the concentrate may range from 1 weight percent to 2 weight percent of the drain cleaner part. Before using such a concentrate to generate a drain cleaning foam, a user may dilute the concentrate with additional water to form a use solution that is then combined with the drain cleaner part containing the hydrogen peroxide. For example, the user may dilute the concentrate so that the concentration of pH buffer in the use solution ranges from 0.01 weight percent to 1.0 weight percent, such as from 0.007 weight percent to 0.15 weight percent. In other examples, the pH buffer may be provided below this concentration range in the drain cleaner part without requiring the user to add additional water. In such examples, the drain cleaner part may be provided as a pre-diluted, ready-to-use formulation.

Optionally Omitted Components

The drain cleaner can have a variety of different components at a variety of different concentration levels, as described herein. In some examples, the drain cleaner is substantially or entirely free of certain components that inhibit the efficacy of the drain cleaner. During use, one compositional part of the drain cleaner containing hydrogen peroxide may be combined with another compositional part of the drain cleaner containing catalase to chemically generate a foam that fills a drain line. As the foam builds within the drain, cleaning and/or sanitizing components carried by and within the foam can contact and act on the sidewalls of the drain. The longer the foam remains stable without breaking, the longer the cleaning and/or sanitizing components can act on the sidewalls of the drain to clean and/or sanitize the drain.

Accordingly, the drain cleaner may be substantially or entirely free of certain components that tend to inhibit foam generation and/or the formation of a stable foam. These defoamer components may include, for example, silica and silicones; aliphatic acids or esters; sulfates or sulfonates; halogenated compounds such as fluorochlorohydrocarbons; vegetable oils, waxes, mineral oils as well as their sulfated derivatives; and phosphates and phosphate esters such as alkyl and alkaline diphosphates, and tributyl phosphates among others; and mixtures thereof. For example, some silicone compounds that may act as defoamers include dimethyl silicone, glycol polysiloxane, methylphenol polysiloxane, trialkyl or tetralkyl silanes, and hydrophobic silica. Depending on the application, the drain cleaner may be substantially or entirely free of one or more of the foregoing compounds. The drain cleaner may be substantially or entirely free in that a concentration of the compounds in the use solution may be less than 0.25 weight percent, such as less than 0.1 weight percent, less than 0.00001 weight percent, or 0 weight percent.

Preparation and Activation of the Drain Cleaner

To prepare a drain cleaner in accordance with the disclosure, the constituent components of the drain cleaner may be selected and combined together according to the parameters outlined above. In general, the constituent components are divided into at least two different compositional parts: a first compositional part that contains hydrogen peroxide and a second compositional part that contains catalase. The remaining components selected for the drain cleaner can be added to one or both of the parts based, e.g., on chemical compatibility, reactivity, and shelf-life. For example, when the drain cleaner includes an amylase, a protease, and an enzyme stabilizer, the components may be added to the part containing the catalyze enzyme. When the drain cleaner further includes a surfactant (e.g., an anionic surfactant and an amphoteric surfactant), the surfactant may be incorporated in the part containing the hydrogen peroxide, the part containing the catalase, or divided between both parts. In different examples in which the drain cleaner further includes a sanitizer, the sanitizer may be incorporated into the part containing the catalase or may form yet a third compositional part of the drain cleaner separate from the other two parts.

After selecting the different components for the drain cleaner and the distribution of the components into the different compositional parts, the components for each individual part may be combined together, e.g., with or without mixing the components together. A suitable amount of water may be added to each compositional part to obtain a desired concentration level for each component. Each compositional part may include a concentration of those components selected for inclusion in the part and a remainder water up to 100 weight percent. The specific concentration of each component may vary, e.g., depending on whether the compositional part is intended to be provided as a concentrate to be diluted before application or as a ready-to-use solution that is fully diluted.

The different compositional parts of the drain cleaner may be physically separated from one another so that the parts do not intermix before application of the drain cleaner. However, a user may be able to intermix the different compositional parts during application of the drain cleaner to chemically self-foam the drain cleaner. In one example, each compositional part is provided in a different container (e.g., bag, box, bottle, tote) so that the different compositional parts are in physically separate containers. In such an example, the drain cleaner may be provided as a system or kit of parts that includes multiple physical containers each housing a different compositional part of the drain cleaner. To apply the drain cleaner, a user may open each separate container and combine the contents of the containers together to activate the drain cleaner. The user may simultaneously dispense the contents of each container, e.g., by pouring the contents of each container down a drain at the same time. Alternatively, a user can dispense the contents of the different containers sequentially, e.g., by pouring the contents of one container (e.g., containing hydrogen peroxide or catalase) down the drain followed by pouring the contents of the other container down the drain.

In still other examples, the different compositional parts of the drain cleaner may be provided in a single container that is physically divided into different compartments separating the compositional parts of the drain cleaner until intended application. FIG. 1 is an illustration of an example container 10 that may be used to transport, store, and/or dispense the different compositional parts of the drain cleaner. Container 10 includes a first chamber 12 and a second chamber 14. First chamber 12 is physically divided from second chamber 14 by barrier 16 so that the contents of the first chamber and second chamber do not intermix within the container. Container 10 also includes an outlet 18 through which the contents of the container are dispensed. Outlet 18, which may comprise two separate outlets for first chamber 12 and second chamber 14, allows the contents of container 10 to be dispensed. During application, a user may pour the contents of container 10 into a drain. As the contents of first chamber 12 and second chamber 14 exit the container via outlet 18, the different compositional parts of the drain cleaner may combine so as to activate and generate foam. In some examples, container 10 includes a mixer (e.g., static mixer) positioned at outlet 18 to help intermix the contents of first chamber 12 and second chamber 14 during dispensing. Additionally, although container 10 is illustrated as only including two chambers, in other examples, the container may include more chambers. For example, container 10 may include a third chamber containing a sanitizing agent. During application, the sanitizing agent may dispense from the container via outlet 18 and combine with the other compositional parts containing hydrogen peroxide and catalase.

The amount of the compositional part containing hydrogen peroxide that is combined with the compositional part containing catalase will depend, for example, on the concentrations of each component in each respective part and the size of the drain to be filled with the foaming composition. In some examples, a sufficient amount of the different compositional parts are combined so that a volume ratio of the compositional part containing hydrogen peroxide to the compositional part containing catalase ranges from approximately 0.25-to-1 to approximately 10-to-1, such as from approximately 0.5-to-1 to 3-to-1. In one example, the ratio is approximately one-to-one. The volume ratio may be calculated by dividing the volume of the drain cleaner part containing hydrogen peroxide by the volume of the drain cleaner part containing catalase.

Container 10 may be sized based on the expected blending ratios of the different compositional parts of the drain cleaner. For example, where the blending ratio of the drain cleaner part containing hydrogen peroxide divided by the volume of the drain cleaner part containing catalase is approximately one-to-one, a volume of first chamber 12 may be approximately equal in a volume of second chamber 14.

During use, the different compositional parts of the drain cleaner are combined together to chemically generate a cleaning and/or sanitizing foam. The different compositional parts may be combined together by pouring the compositional parts down a soiled drain to be cleaned. As the foam builds within the drain, cleaning and/or sanitizing components carried by and within the foam can contact and act on the sidewalls of the drain.

Figure 2:
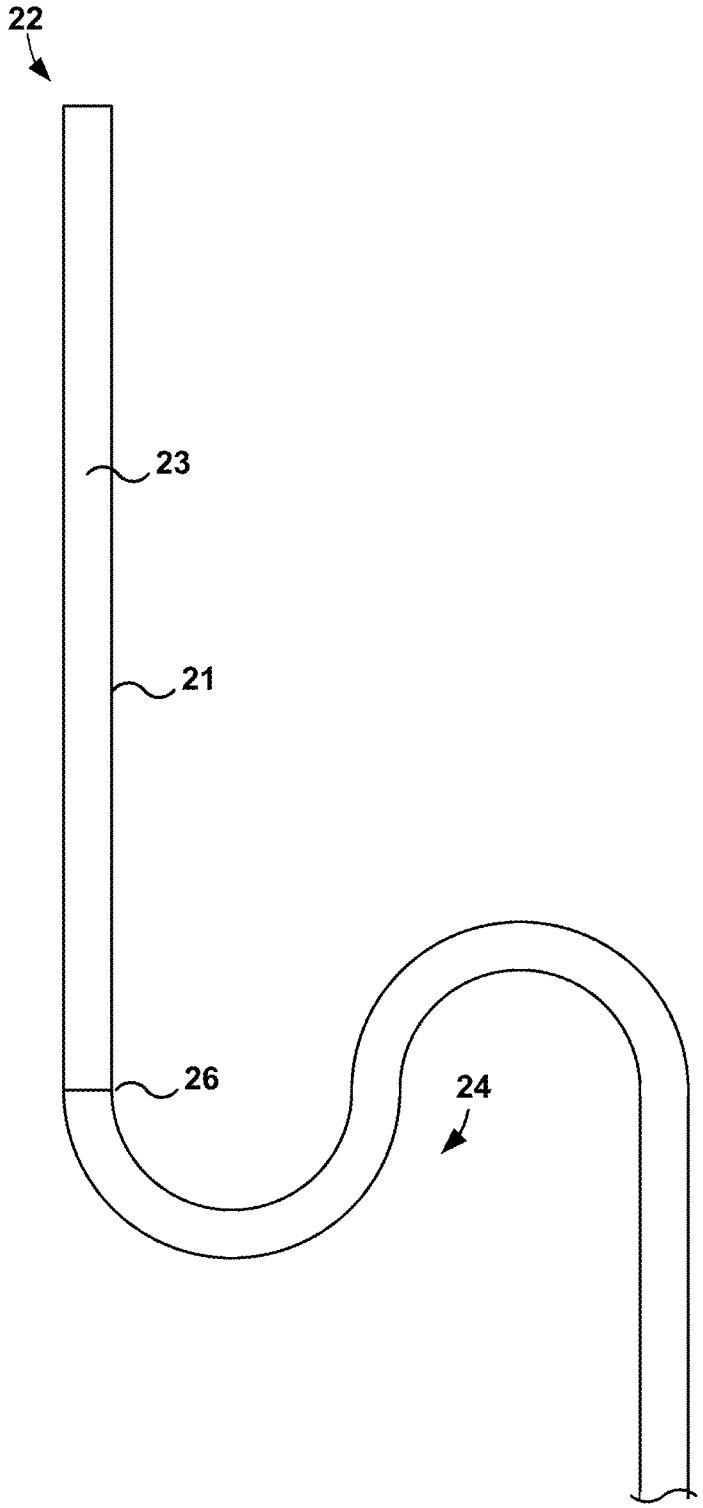
FIG. 2 is an illustration of an example drain that can be cleaned using a drain cleaner in accordance with the disclosure.

FIG. 2 is an illustration of an example drain 20 that can be cleaned using a drain cleaner in accordance with the disclosure. Drain 20 includes a drain pipe 21 having a drain opening 22 through which fluid and debris enter the drain pipe during normal operation. Drain 20 also includes a trap 24, which is a localized low point in the pumping that traps water to create a seal preventing sewer gas from passing through the drain pipe back up into an occupied space in a building. Trap 24 may also trap debris entering the drain and limit the size of objects that will pass on into the rest of the plumbing, thereby catching over-sized objects. Over time, soil can build-up on internal sidewall 23 of the drain pipe, and a drain cleaner in accordance with the disclosure may be used to clean the soil from the sidewall.

During use of the drain cleaner, the different compositional parts of the cleaner may be dispensed into opening 22. Within drain pipe 21, the drain cleaner may generate a foam by decomposition of hydrogen peroxide that expands and completely fills the drain pipe with a cleaning and/or sanitizing foam. For example, the foam generated by the drain cleaner may extend from a water level 26 in trap 24 up to, and in some examples through, drain opening 22. The foam may contact and completely cover internal sidewall 23 of drain pipe 24, e.g., so that the foam is in contact with the entire inner diameter of the drain pipe between water level 26 and opening 22.

To help ensure that the drain cleaner fills the drain with foam, the drain cleaner may rapidly generate foam upon combining the different compositional parts of the drain cleaner. For example, upon combining 50 ml of the compositional part containing the hydrogen peroxide with 50 ml of the compositional part containing the catalase, where one or both of the compositional parts further include surfactant, the combined components may generate enough foam to fill a 2 inch diameter pipe with at least 24 inches of foam in at least 1 minute.

Rapidly generated foam may be beneficial to help prevent the drain cleaner from discharging through drain 20 via trap 24. For example, if the drain cleaner foam does not generate rapidly enough, the different compositional parts of the drain cleaner may settle in trap 24. When this occurs, the drain cleaner components may not react together to generate a foam or may generate a foam that pushes through water in trap 24 so that the foam fails to clean the section of drain between opening 22 and water line 24. This may be especially true where drain pipe 20 is a larger volume large pipe, for example, having a diameter greater than or equal to 2 inches, such as a diameter greater than or equal to 5 inches, a diameter greater than or equal to 6 inches, or a diameter greater than or equal to 8 inches.

As the foam generated by the drain cleaner resides in contact with internal sidewall 23 of drain pipe 21, cleaning and/or sanitizing components carried within the foam can act on soil within the drain pipe to clean and/or sanitize the drain. After a suitable period of time (e.g., greater than 5 minutes) where the foam is in contact with the drain pipe, the drain pipe can be flushed with wither. When this occurs, the flushing water can break the drain cleaner foam and remove soil from sidewall 23 that was loosen by the drain cleaner foam, thereby cleaning and/or sanitizing the drain.

While use of the drain cleaner has been described in connection with the example drain configuration of FIG. 2, it should be appreciated that the drain cleaner is not limited to use in a drain having any particular configuration, much less the specific configuration of FIG. 2. Moreover, while a drain cleaner in accordance with the disclosure may be useful for cleaning drains, the cleaner is not limited to such an application. Additional surfaces that may be cleaned using the drain cleaner include, but are not limited to, medical devices, laundry and/or textiles, hard surfaces (e.g., walls, floors), dishes, flatware, pots and pans, heat exchange coils, ovens, fryers, smoke houses, other drain lines, and vehicles.

In addition, although the drain cleaner composition may typically be used as a chemically self-generating foam composition, it is also contemplated that the drain cleaner can be mechanically foamed and applied via a mechanical foaming head. A mechanical foaming head may provide foam generation by causing air and the drain cleaner composition to mix and create a foamed composition. That is, the mechanical foaming head can cause air and the drain cleaner composition to mix in a mixing chamber and then pass through an opening to create a foam that is dispensed. In such examples, only a single compositional portion of the drain cleaner composition described herein, such as the compositional portion described as containing the catalase, may be mechanically foamed using the mechanical foaming head. Further, even in those examples, the catalase enzyme may be omitted from the compositional portion as the catalase may not be needed to decompose hydrogen peroxide. The following examples may provide additional details about a drain cleaner in accordance with this disclosure.

EXAMPLES

Example Set 1

Drain cleaner compositions having a variety of formulations were generated and tested to evaluate the efficacy of their cleaning, sanitizing, and foaming properties. A first example composition was generated having the following formulation:

First Compositional Part

| Chemical Class | Specific Compound/ Trade name | Wt % in Concentrate | Wt % in Dilute Use Solution |
|---|---|---|---|
| Solvent | Water | 48.5 | 98.3900 |
| pH Buffer | Sodium Bicarbonate | 1.5 | 0.0469 |
| Water Conditioner | Belclene 810 (polycaroxylic acid) | 0.13 | 0.0039 |
| Amphoteric Surfactant | Barlox 14 (amine oxide) | 15 | 0.4690 |
| Anionic Surfactant | Sodium Lauryl Sulfate | 1 | 0.0313 |
| Enzyme Stabilizer/ Filler | Glycerin | 30 | 0.9380 |
| Protease | Savinase Ultra 16L | 0.5 | 0.0156 |
| Catalase | Terminox Supreme 1000BCU | 3 | 0.0938 |
| Fragrance | Citrus Fragrance | 0.3 | 0.0094 |
| Colorant | FD&C Red #40 | 0.05 | 0.0016 |

Second Compositional Part

| Chemical Class | Specific Compound | Wt % |
|---|---|---|
| Oxygen Source | Hydrogen Peroxide | 8 |
| Solvent | Water | 92 |

The two compositional parts were combined in a one-to-one volume ratio to chemically generate a foam. The drain cleaner composition showed excellent performance at removing target soils typically found in drains and generated a fast-acting, stable foam when the two compositional parts were combined. For example, upon combining 50 ml of the first compositional part with 50 ml of the second compositional part, the combined components generated enough foam to fill a 2 inch diameter pipe with at least 24 inches of foam in at least 1 minute. The foam remained stable and in complete contact with the wall surfaces of the pipe for at least five minutes.

When the amylase Stainzyme Plus was added to the composition, the drain cleaner showed enhanced ability to remove starch-based drain soils. The amylase did not deteriorate the foam generation of foam stability characteristics of the drain cleaner composition. Further, when the modified composition was subjected to accelerated shelf-life testing in which the composition was stored at a temperature of 40 degrees Celsius for 4 weeks, the drain cleaner maintained its effectiveness at foaming and cleaning.

A second example composition was generated having the following formulation:

First Compositional Part

| Chemical Class | Specific Compound/ Trade name | Wt % in Concentrate | Wt % in Dilute Use Solution |
|---|---|---|---|
| Solvent | Water | 45.374 | 98.293 |
| pH Buffer | Sodium Bicarbonate | 1.5 | 0.0469 |
| Water Conditioner | Belclene 810 | 0.126 | 0.0039 |
| Amphoteric Surfactant | Barlox 14 (amine oxide) | 15 | 0.4688 |
| Anionic Surfactant | Sodium Lauryl Sulfate | 1 | 0.0313 |
| Sanitizing Agent | Lonzabac 12.100 | 1.5 | 0.0468 |
| Enzyme Stablizer/ Filler | Glycerin | 30 | 0.9376 |
| Protease | Savinase Ultra 16L | 0.5 | 0.0156 |
| Catalase | Terminox Supreme 1000BCU | 5 | 0.1563 |

Second Compositional Part

| Chemical Class | Specific Compound | Wt % |
|---|---|---|
| Oxygen Source | Hydrogen Peroxide | 8 |
| Solvent | Water | 92 |

Upon generating the drain cleaner compositional parts and then combining the two different compositional parts in a one-to-one volume ratio together, the drain cleaner showed excellent foam generation and foam stability, consistent with example 1. Further, when the foam generated by the drain cleaner was left in contact with a surface containing *Staphylococcus aureus, Enterobacter aerogenes*, and *Listeria monocytogenes*, for five minutes, the drain cleaner was effective to cause a greater than 99.9% reduction (3-log order reduction) in a population of the bacteria.

When the composition was subjected to accelerated shelf-life testing in which the composition was stored at a temperature of 40 degrees Celsius for 4 weeks, the activity of the catalase appeared to deteriorate so that the foam generated after 4 weeks was neither as robust nor as stable as when the drain cleaner compositional parts were freshly formulated.

Additional drain cleaner compositions were generated having the following formulations:

First Compositional Part

| Chemical Class | Specific Compound/ Trade name | Wt % in Dilute Use Solution EX 3 | EX 4 | EX 5 | EX 6 | EX 7 |
|---|---|---|---|---|---|---|
| Surfactant | Glucopon 625 UP (50%) (lauryl polyglucose) | | | | 0.3 | 0.224 |
| Surfactant | Cocamidopropyl Betaine (35%) | 0.06 | | 0.06 | | 0.06 |
| Surfactant | Cocamide DEA (85%) | 0.02 | | 0.02 | | 0.02 |
| Surfactant | Barlox 14 (amine oxide) | 0.373 | 0.5000 | 0.373 | | |
| pH Buffer | Sodium Bicarbonate | 0.047 | 0.2500 | 0.25 | 0.25 | 0.25 |
| Protease | Savinase Ultra 16L | 0.0076 | 0.0076 | 0.0076 | 0.0076 | 0.0076 |

-continued

First Compositional Part

| Chemical Class | Specific Compound/ Trade name | Wt % in Dilute Use Solution EX 3 | EX 4 | EX 5 | EX 6 | EX 7 |
|---|---|---|---|---|---|---|
| Catalase | Terminox Supreme 1000BCU | 0.05 | 0.0500 | 0.05 | 0.05 | 0.05 |
| Solvent | Water | 99.44 | 99.2000 | 99.25 | 99.4 | 99.4 |

Second Compositional Part

| Chemical Class | Specific Compound | Wt % |
|---|---|---|
| Oxygen Source | Hydrogen Peroxide | 35 |
| Solvent | Water | 65 |

For each example, 200 ml of the first compositional part was combined with 40 ml of the second compositional part to generate a drain cleaning foam. The different compositions were evaluated for cleaning and foaming effectiveness. The foam generated in example 6 using the lauryl polyglucose surfactant appeared to generated larger air bubbles, resulting in a less dense and less stable foam than the foam generated in example 4 using the amine oxide surfactant. It is expected that a more dense and stable foam will provide a more efficacious cleaning. Further, the addition of cocamidopropyl betaine and cocamide DEA in examples 3, 5, and 7 did not appear to have any material effect on the cleaning or foaming properties of the drain cleaning composition.

A tenth example drain cleaner composition was generated having the following formulation:

First Compositional Part

| Chemical Class | Specific Compound/ Trade name | Wt % in Dilute Use Solution |
|---|---|---|
| Solvent | Water | 99.505 |
| Foam Thickener | Jaguar HP-120 | 0.01 |
| pH Buffer | Sodium Bicarbonate | 0.25 |
| Surfactant | Plantopon LGC SQRB | 0.1 |
| Protease | Savinase Ultra 16L | 0.0375 |
| Catalase | Terminox Supreme 1000BCU | 0.1 |
| Colorant | FDC Blue #1 | 0.00005 |

Second Compositional Part

| Chemical Class | Specific Compound | Wt % |
|---|---|---|
| Oxygen Source | Hydrogen Peroxide | 35 |
| Solvent | Water | 65 |

The two compositional parts were combined by mixing 200 ml of the first compositional part with 40 ml of the second compositional part. Plantopon, which is a C10-16 alkylpolyglucoside carboxylate surfactant, did not generate a sufficient volume of foam to fill a 2 inch diameter pipe with at least 24 inches of foam in at least 1 minute.

Additional drain cleaner compositions were generated having the following formulations:

First Compositional Part

| Chemical Class | Specific Compound/ Trade name | Wt % in Dilute Use Solution | | |
|---|---|---|---|---|
| | | EX 11 | EX 12 | EX 13 |
| Solvent | Water | 85.8 | 81.3 | 81.3 |
| Foam Thickener | Jaguar HP-120 | 0.05 | 0.05 | 0.05 |
| pH Buffer | Sodium Bicarbonate | 1.5 | 1.5 | 1.5 |
| Foam Thickener | Mackam HPL-28 | | 1.5 | |
| Foam Thickener | Mackam CSF-CG | | | 1.5 |
| Surfactant | Barlox 12 (amine oxide) | 1 | 1 | 1 |
| Surfactant | Barlox 12 (amine oxide) | 0.5 | 0.5 | 0.5 |
| Protease | Savinase Ultra 16L | 1 | 1 | 1 |
| Catalase | Terminox Supreme 1000BCU | 0.15 | 0.15 | 0.15 |

Second Compositional Part (Solid)

| Chemical Class | Specific Compound | Wt % |
|---|---|---|
| Oxygen Source | Urea Peroxide | 50 |
| | Sodium Bicarbonate | 50 |

For each example, the first compositional part was combined based on weight with the second compositional part so that the first compositional part comprised 90 weight percent combination and the second compositional part comprised 10 weight percent of the combination. A total of 200 ml of the first compositional part was combined with the second compositional part. The different compositions were then evaluated for cleaning and foaming effectiveness. The foam generated in each example was more dense and stable than in example 10 but did not generate rapidly. For example, the compositions did not foam fast enough to fill a 2 inch diameter pipe with at least 24 inches of foam in at least 1 minute.

Example Set 2

This example set was run to determine the shelf stability of different drain cleaner compositions, particularly with respect to catalase activity and the foam generating ability of the drain cleaner over time. A variety of drain cleaner compositional parts containing catalase were formulated and subjected to accelerated shelf-life testing whereby the compositions were stored at a temperature of 40 degrees Celsius for 4 weeks. At the end of each week during the 4 week cycle, the drain cleaner compositional part was sampled and combined with a peroxide solution. Drain cleaners were generated having the following formulations:

First Compositional Part

| Chemical Class | Specific Compound/ Trade name | Wt % in Concentrate | | | | | |
|---|---|---|---|---|---|---|---|
| | | EX 1 | EX 2 | EX 3 | EX 4 | EX 5 | EX 6 |
| Solvent | Water | 44.77 | 49.52 | 49.02 | 49.02 | 46.87 | 46.37 |
| pH Buffer | Sodium Bicarbonate | 1.5 | 1 | 1 | 1 | 1.5 | 1.5 |
| Enzyme Stablizer/ Filler | Glycerin | 30 | 30 | 30 | 30 | 30 | 30 |
| Sanitizing Agent | Lonzabac 12.100 | 1.5 | | | | | |
| | Citric Acid | 0.6 | | | | | |
| Amphoteric Surfactant | Barlox 14 (amine oxide) | 15 | 15 | 15 | 15 | 15 | 15 |
| Anionic Surfactant | Sodium Lauryl Sulfate | 1 | 1 | 1 | 1 | 1 | 1 |
| Water Conditioner | Belclene 810 | 0.126 | 0.126 | 0.126 | 0.126 | 0.126 | 0.126 |
| Protease | Savinase 16L | | | 0.5 | | | |
| Protease | Savinase Ultra 16L | 0.5 | | | 0.5 | 0.5 | 0.5 |
| Catalase | Terminox Supreme 1000BCU | 5 | 3 | 3 | 3 | 5 | 5 |
| Catalase | Stainzyme Plus | | | | | | 0.5 |
| Colorant | FD&C Red #40 | | 0.05 | 0.05 | 0.05 | | |
| Fragrance | Citrus Fragrance | | 0.3 | 0.3 | 0.3 | | |
| Resulting pH of Solution | | 9.2 | 8.16 | 8.2 | 8.15 | 8.47 | 8.48 |

| Second Compositional Part | | |
|---|---|---|
| Chemical Class | Specific Compound | Wt % |
| Oxygen Source | Hydrogen Peroxide | 8 |
| Solvent | Water | 92 |

Figure 3:
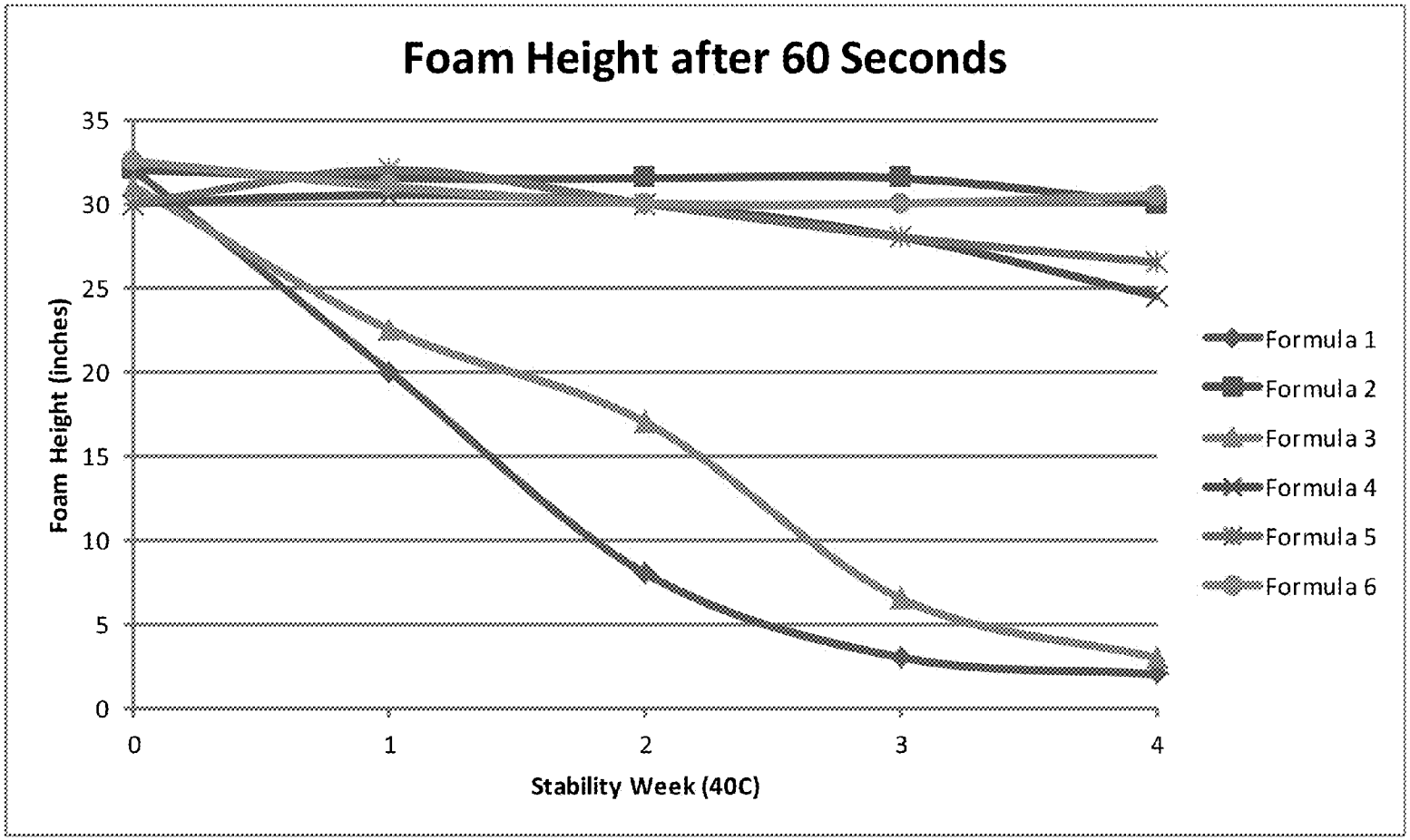
FIGS. 3-5 of plots of different example foam heights that may be generated by a drain cleaner in accordance with the disclosure.

For each example, 1.6 ml of the concentrate was diluted in 50 ml of water and then dumped along with 50 ml of the peroxide solution into a 3 foot long, 2 inch diameter clear pipe having a capped bottom to hold the contents. The height of the foam in the pipe generated after 1 minute was recorded. FIG. 3 is a plot of the foam heights recorded for each sample during the 4 week testing duration. The y-axis of the plot is the foam height measured in the pipe after one minute. The x-axis of the plot is the duration in number of weeks that the composition had been stored at 40 degrees Celsius.

The data show that the foam height generated by compositions of examples 1 and 3 deteriorated more significantly after 4 weeks at temperature than the other four compositions analyzed. Without wishing to be bound by any particular theory, it is believed that the elevated pH of example 1 caused by the addition of the Lonzabac 12.100 reduced the catalase activity over time. With respect to example 3, the composition utilized Savinase 16L as a protease instead of Savinase Ultra 16L. Savinase Ultra 16L contains a supplier-added enzyme stabilizer (4-formyl phenyl boronic acid) not present in the Savinase 16L. This enzyme stabilizer is believed to have helped prevent the protease from degrading the catalase over time.

Example Set 3

This example set was run to determine the shelf stability of different drain cleaner compositions containing a sanitizing agent, particularly with respect to catalase activity and the foam generating ability of the drain cleaner over time. A variety of drain cleaner compositional parts containing catalase and sanitizing agent were formulated and subjected to accelerated shelf-life testing whereby the compositions were stored at a temperature of 40 degrees Celsius for 4 weeks. At the end of each week during the 4 week cycle, the drain cleaner compositional part was sampled and combined with a peroxide solution. Drain cleaners were generated having the following formulations:

| First Compositional Part | | | | | | | | | | |
|---|---|---|---|---|---|---|---|---|---|---|
| Chemical Class | Specific Compound/ Trade name | Wt % in Concentrate | | | | | | | | |
| | | EX 1 | EX 2 | EX 3 | EX 4 | EX 5 | EX 6 | EX 7 | EX 8 | EX 9 |
| Solvent | Water | 44.77 | 24.77 | 44.37 | 24.37 | 44.17 | 44.17 | 24.17 | 46.87 | 46.37 |
| Thickener | Xanthan Gum | | | 0.4 | 0.4 | 0.6 | 0.6 | 0.6 | | |
| pH Buffer | Sodium Bicarbonate | 1.5 | 1.5 | 1.5 | 1.5 | 1.5 | 1.5 | 1.5 | 1.5 | 1.5 |
| Enzyme Stablizer/ Filler | Glycerin | 30 | 50 | 30 | 50 | 30 | 30 | 50 | 30 | 30 |
| Sanitizing Agent | Lonzabac 12.100 | 1.5 | 1.5 | 1.5 | 1.5 | 1.5 | 1.5 | 1.5 | | |
| | Citric Acid | 0.6 | 0.6 | 0.6 | 0.6 | 0.6 | 0.6 | 0.6 | | |
| Amphoteric Surfactant | Barlox 14 (amine oxide) | 15 | 15 | 15 | 15 | 15 | 15 | 15 | 15 | 15 |
| Anionic Surfactant | Sodium Lauryl Sulfate | 1 | 1 | 1 | 1 | 1 | 1 | 1 | 1 | 1 |
| Water Conditioner | Belclene 810 | 0.126 | 0.126 | 0.126 | 0.126 | 0.126 | 0.126 | 0.126 | 0.126 | 0.126 |
| Protease | Savinase Ultra 16L | 0.5 | 0.5 | 0.5 | 0.5 | 0.5 | 0.5 | 0.5 | 0.5 | 0.5 |
| Catalase | Terminox Supreme 1000BCU | 5 | 5 | 5 | 5 | 5 | 5 | 5 | 5 | 5 |
| Amylase | Stainzyme Plus | | | | | | | | | 0.5 |

Figure 4:
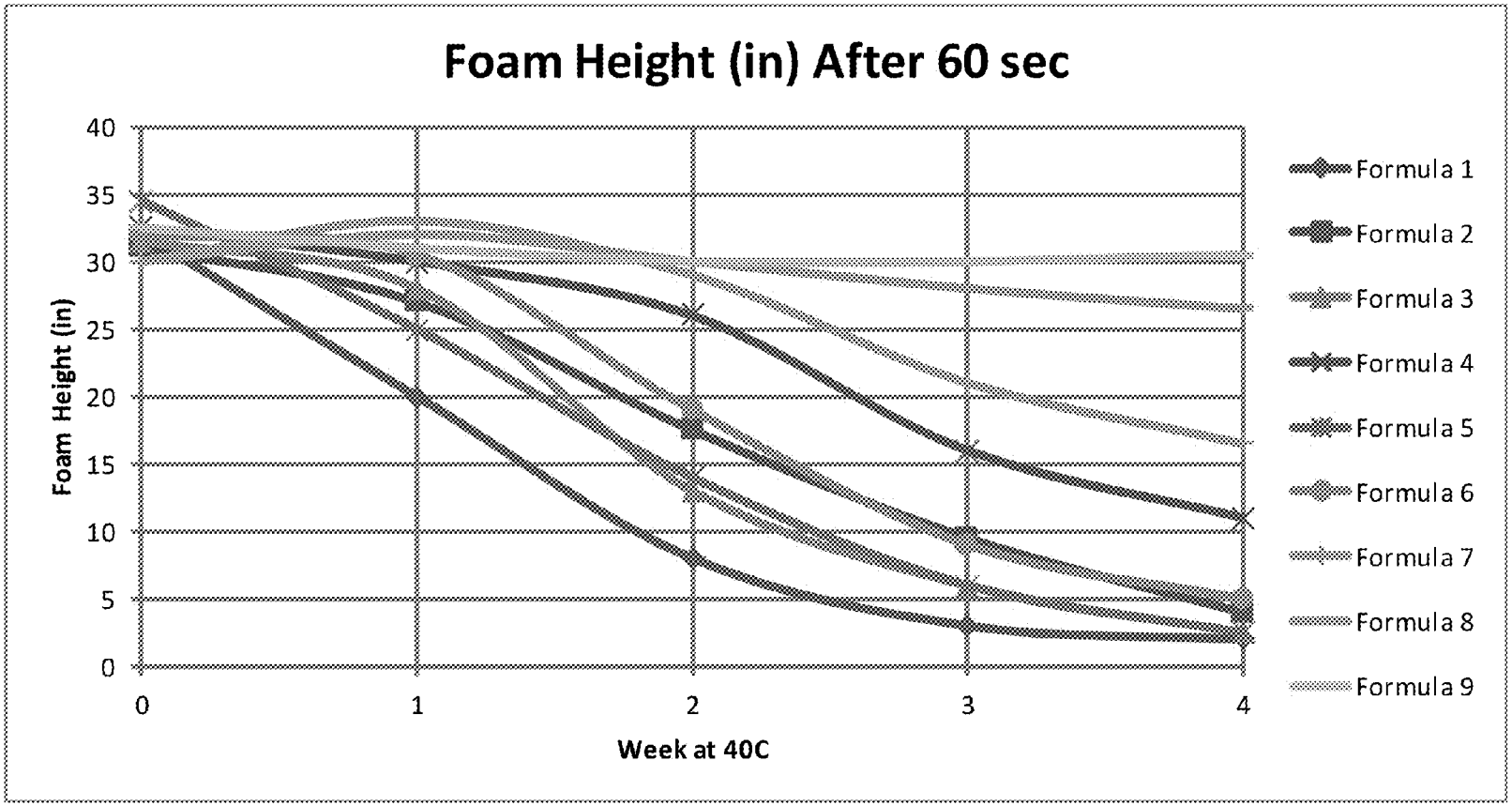

For each example, 1.6 ml of the concentrate was diluted in 50 ml of water and then dumped along with 50 ml of the peroxide solution into a 3 foot long, 2 inch diameter clear pipe having a capped bottom to hold the contents. The height of the foam in the pipe generated after 1 minute was recorded. FIG. 4 is a plot of the foam heights recorded for each sample during the 4 week testing duration. The y-axis of the plot is the foam height measured in the pipe after one minute. The x-axis of the plot is the duration in number of weeks that the composition had been stored at 40 degrees Celsius.

The data show that the foam height generated by the compositions of examples 8 and 9, which did not include the Lonzabac 12.100 sanitizing agent, maintained the best foam height generating ability over the 4 weeks of testing. For compositions that did include the Lonzabac 12.100, the composition of example 7 performed the best followed by the composition of example 4. For example, the foam height of example 7 deteriorated less than 50% over the four weeks of testing. Examples 4 and 7 had the highest levels of enzyme stabilizer of any of the Lonzabac-containing compositions tested in this example set.

Example Set 4

This example set was run to determine the effectiveness of different drain cleaner compositions on cleaning fat soils. For the test, 316 stainless steel coupons (3"×5") were first cleaned and dried. 100 milligrams of lard fat was then coated on each of the coupons and allowed to dry. The mixture included a red dye to highlight fat soil on the coupons.

Drain cleaner foam was then generated by combining a first compositional part as set forth in the table below with a second compositional part as also set forth below in a one-to-one volume ratio. The foam was allowed to reside on the coupons for 5 minutes, after which image analysis was performed on the coupons to determine the percent of soil removed (based on area). The results are presented in the table below.

First Compositional Part

| Chemical Class | Specific Compound/ Trade name | Wt % in Dilute Use Solution EX 1 | EX 2 | EX 3 | EX 4 |
|---|---|---|---|---|---|
| Solvent | Water | 99.2 | 99.247 | 99.4 | 99.396 |
| Surfactant | Glucopon 625 UP (50%) (lauryl polyglucose) | 0 | 0.0000 | 0.3 | 0.224 |
| Surfactant | Cocamidopropyl Betaine (35%) | 0 | 0.0600 | 0 | 0.06 |
| Surfactant | Cocamide DEA (85%) | 0 | 0.0200 | 0 | 0.02 |
| Surfactant | Barlox 14 (amine oxide) | 0.5 | 0.3730 | 0 | 0 |
| pH Buffer | Sodium Bicarbonate | 0.25 | 0.2500 | 0.25 | 0.25 |
| Protease | Savinase Ultra 16L | 0 | 0.0000 | 0 | 0 |
| Catalase | Terminox Supreme 1000BCU | 0.05 | 0.0500 | 0.05 | 0.05 |
| Percent Soil Removed | | 99.5 | 98.6 | 70.6 | 8.1 |

Second Compositional Part

| Chemical Class | Specific Compound | Wt % |
|---|---|---|
| Oxygen Source | Hydrogen Peroxide | 8 |
| Solvent | Water | 92 |

For the example compositions tested, the lauryl polyglucose surfactant appeared to be less effective at cleaning the fat soil than the amine oxide surfactant. Further, the addition of cocamidopropyl betaine and cocamide DEA in the compositions did not appear to have any material effect on the fat cleaning properties of the drain cleaning compositions.

Example Set 5

This example set was run to determine the shelf stability of different drain cleaner compositions, particularly with respect to the effect of pH on catalase activity and the foam generating ability of the drain cleaner over time. Different drain cleaners were formulated as set forth in the table below and subjected to accelerated shelf-life testing as described with respect to Example Set 3.

First Compositional Part

| Chemical Class | Specific Compound/ Trade name | Wt % in Concentrate EX 1 | EX 2 | EX 3 |
|---|---|---|---|---|
| Solvent | Water | 44.774 | 46.874 | 46.374 |
| pH Buffer | Sodium Bicarbonate | 1.5 | 1.5 | 1.5 |
| Enzyme Stablizer/ Filler | Glycerin | 30 | 30 | 30 |
| Sanitizing Agent | Lonzabac 12.100 | 1.5 | | |
| | Citric Acid | 0.6 | | |
| Amphoteric Surfactant | Barlox 14 (amine oxide) | 15 | 15 | 15 |
| Anionic Surfactant | Sodium Lauryl Sulfate | 1 | 1 | 1 |
| Water Conditioner | Belclene 810 | 0.126 | 0.126 | 0.126 |
| Protease | Savinase Ultra 16L | 0.5 | 0.5 | 0.5 |
| Catalase | Terminox Supreme 1000BCU | 5 | 5 | 5 |
| Amylase | Stainzyme Plus | | | 0.5 |
| pH | | 9.5 | 8 | 8 |

Second Compositional Part

| Chemical Class | Specific Compound | Wt % |
|---|---|---|
| Oxygen Source | Hydrogen Peroxide | 8 |
| Solvent | Water | 92 |

Figure 5:
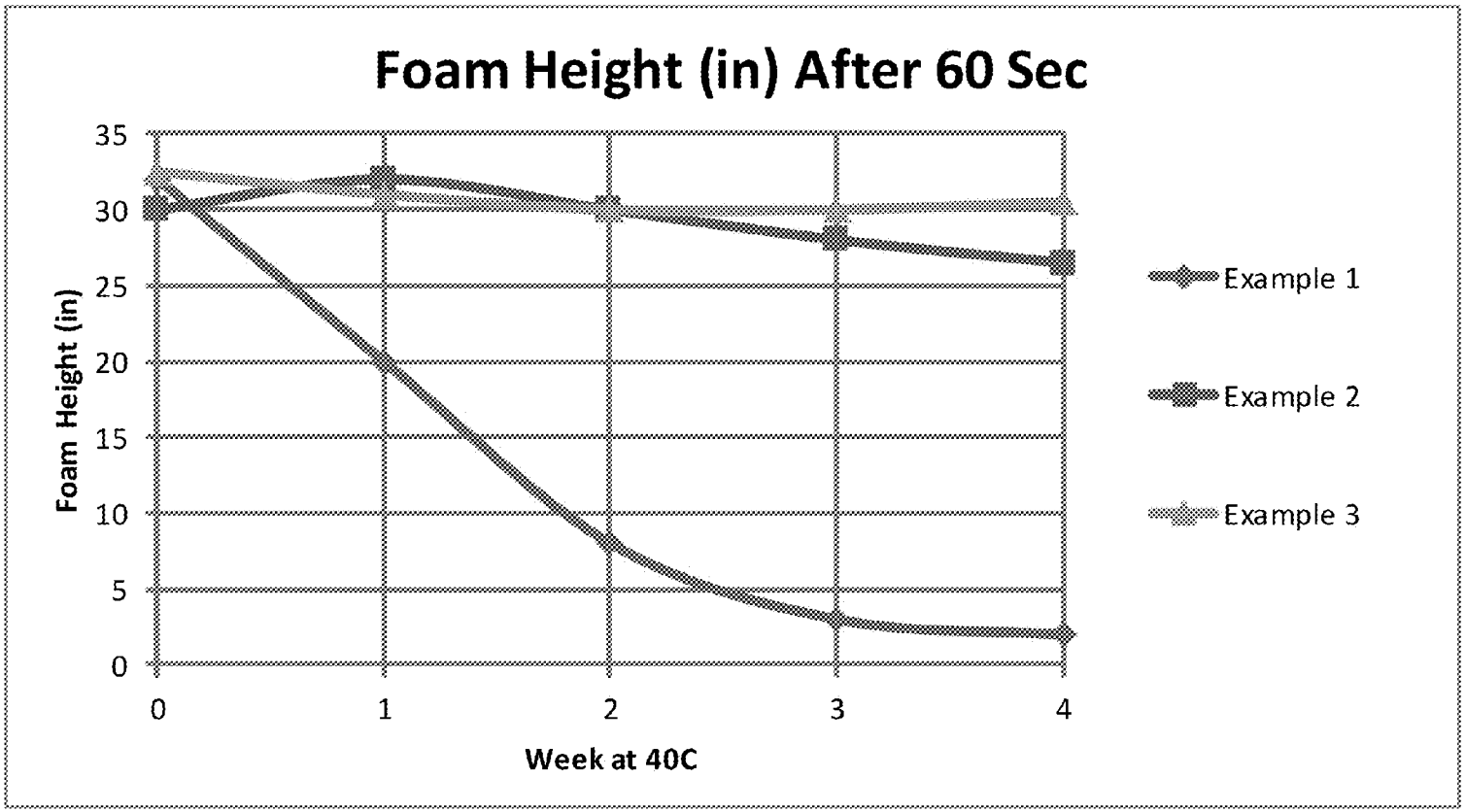

For each example, 1.6 ml of the concentrate was diluted in 50 ml of water and then dumped along with 50 ml of the peroxide solution into a 3 foot long, 2 inch diameter clear pipe having a capped bottom to hold the contents. The height of the foam in the pipe generated after 1 minute was recorded. FIG. 5 is a plot of the foam heights recorded for each sample during the 4 week testing duration. The y-axis of the plot is the foam height measured in the pipe after one minute. The x-axis of the plot is the duration in number of weeks that the composition had been stored at 40 degrees Celsius.

The data show that the foam height generated by the compositions of examples 2 and 3 having the lower pH maintained the best foam height generating ability over the 4 weeks of testing.

The invention claimed is:

1. A foaming drain cleaner system comprising:

a first part that includes hydrogen peroxide and water;

a second part that includes a catalase, an amylase, a protease, and an enzyme stabilizer; and a surfactant present in at least one of the first part and the second part, the surfactant comprising an anionic surfactant and an amphoteric surfactant, wherein the first part is separated from the second part so that the first part and the second part do not intermix.

2. The system of claim 1, wherein the surfactant is present in the second part.

3. The system of claim 2, wherein the catalase ranges from 3 weight percent to 15 weight percent of the second part;

the amylase ranges from 0.05 weight percent to 5 weight percent of the second part;

the protease ranges from 0.05 weight percent to 5 weight percent of the second part;

the enzyme stabilizer ranges from 15 weight percent to 70 weight percent of the second part; and the surfactant ranges from 5 weight percent to 40 weight percent of the second part, wherein the weight percentages in the second part are calculated excluding any weight of water.

4. The system of claim 2, wherein a ratio of the amphoteric surfactant divided by the anionic surfactant ranges from approximately 5 to approximately 25.

5. The system of claim 2, wherein the catalase ranges from 5 weight percent to 12 weight percent of the second part;

the amylase comprises an alpha amylase and ranges from 0.1 weight percent to 2 weight percent of the second part;

the protease comprises a subtilisin protease and ranges from 0.1 weight percent to 2 weight percent of the second part;

the enzyme stabilizer comprises a polyhydric alcohol and ranges from 30 weight percent to 60 weight percent of the second part; and the surfactant ranges from 10 weight percent to 30 weight percent of the second part with the anionic surfactant comprising an alkyl sulfate and the amphoteric surfactant comprising an alkyl amine oxide, wherein the weight percentages in the second part are calculated excluding any weight of water.

6. The system of claim 5, wherein the second part further comprises a water conditioner and a pH buffer.

7. The system of claim 6, wherein the water conditioner comprises a polycarboxylic acid ranging from 0.05 to 5 weight percent of the second part and the pH buffer comprises sodium bicarbonate ranging from 1 to 10 weight percent of the second part.

8. The system of claim 2, wherein the catalase ranges from 5 weight percent to 12 weight percent of the second part;

the amylase comprises an alpha amylase and ranges from 0.1 weight percent to 2 weight percent of the second part;

the protease comprises a subtilisin protease and ranges from 0.1 weight percent to 2 weight percent of the second part;

the enzyme stabilizer comprises a polyhydric alcohol having a carbon chain of two or three carbons in length and ranging from 30 weight percent to 60 weight percent of the second part; and the surfactant ranges from 10 weight percent to 30 weight percent of the second part with the anionic surfactant comprising sodium lauryl sulfate and the amphoteric surfactant comprises N-alkyl dimethylamine oxide having a carbon chain of twelve to fourteen carbons in length.

9. The system of claim 2, wherein the first part comprises less than 10 weight percent hydrogen peroxide, the second part further comprises water, and wherein the catalase ranges from 0.001 weight percent to 0.1 weight percent of the second part;

the amylase ranges from 0.001 weight percent to 0.02 weight percent of the second part;

the protease ranges from 0.001 weight percent to 0.02 weight percent of the second part;

the enzyme stabilizer comprises a polyhydric alcohol and ranges from 0.5 weight percent to 2 weight percent of the second part;

the surfactant ranges from 0.1 weight percent to 0.6 weight percent of the second part and comprises an anionic surfactant and an amphoteric surfactant with the anionic surfactant comprising an alkyl sulfate and the amphoteric surfactant comprising an alkyl amine oxide, and a ratio of the amphoteric surfactant divided by the anionic surfactant ranges from 10 to 20; and a remainder of the second part includes the water up to 100 weight percent.

10. The system of claim 9, wherein the second part further comprises a water conditioner and a pH buffer, the water conditioner comprising less than 0.1 weight percent of the second part and the pH buffer ranging from 0.1 weight percent to 1 weight percent of the second part.

11. The system of claim 1, further comprising a container containing the first part and the second part, wherein the container is divided into a first chamber containing the first part and a second chamber containing the second part, and the container has an outlet configured so that the first part combines with the second part when contents of the container are dispensed.

12. The system of claim 11, wherein a volume of the first chamber is approximately equal to a volume of the second chamber so that the first part and the second part combine in an approximately one-to-one ratio when dispensing the contents of the container.

13. A method comprising:

combining a first part that includes hydrogen peroxide and water with a second part that includes a catalase, an amylase, a protease, an enzyme stabilizer, and a surfactant so as to generate a cleaning foam, wherein the surfactant comprises an anionic surfactant and an amphoteric surfactant.

14. The method of claim 13, wherein the catalase ranges from 3 weight percent to 15 weight percent of the second part;

the amylase ranges from 0.05 weight percent to 5 weight percent of the second part;

the protease ranges from 0.05 weight percent to 5 weight percent of the second part;

the enzyme stabilizer ranges from 15 weight percent to 70 weight percent of the second part; and the surfactant ranges from 5 weight percent to 40 weight percent of the second part, wherein the weight percentages in the second part are calculated excluding any weight of water.

15. The method of claim 13, wherein a ratio of the amphoteric surfactant divided by the anionic surfactant ranges from approximately 5 to approximately 25.

16. The method of claim 15, wherein the catalase ranges from 5 weight percent to 12 weight percent of the second part;

the amylase comprises an alpha amylase and ranges from 0.1 weight percent to 2 weight percent of the second part;

the protease comprises a subtilisin protease and ranges from 0.1 weight percent to 2 weight percent of the second part;

the enzyme stabilizer comprises a polyhydric alcohol and ranges from 30 weight percent to 60 weight percent of the second part; and the surfactant ranges from 10 weight percent to 30 weight percent of the second part with the anionic surfactant comprising an alkyl sulfate and the amphoteric surfactant comprising an alkyl amine oxide, wherein the weight percentages in the second part are calculated excluding any weight of water.

17. The method of claim 16, wherein the second part further comprises a water conditioner that includes a polycarboxylic acid ranging from 0.05 to 5 weight percent of the second part and a pH buffer ranging from 1 to 10 weight percent of the second part.

18. The method of claim 13, wherein the first part comprises less than 10 weight percent hydrogen peroxide, the second part further comprises water, and wherein the catalase ranges from 0.001 weight percent to 0.1 weight percent of the second part;

the amylase ranges from 0.001 weight percent to 0.02 weight percent of the second part;

the protease ranges from 0.001 weight percent to 0.02 weight percent of the second part;

the enzyme stabilizer comprises a polyhydric alcohol and ranges from 0.5 weight percent to 2 weight percent of the second part;

the surfactant ranges from 0.1 weight percent to 0.6 weight percent of the second part and exhibits a ratio of the amphoteric surfactant divided by the anionic surfactant ranging from 10 to 20; and a remainder of the second part includes the water up to 100 weight percent.

19. The method of claim 13, wherein combining the first part with the second part comprises combining the first part with the second part in an approximately one-to-one volume ratio.

20. The method of claim 13, wherein combining the first part with the second part comprises dispensing the first part and the second part simultaneously into a drain so as to generate the cleaning foam in the drain.

21. The method of claim 20, wherein the drain has a diameter greater than or equal to 5 inches, and the cleaning foam contacts all surfaces of the drain for at least 5 minutes before breaking.

* * * * *